US007222595B2

(12) United States Patent
Inomoto et al.

(10) Patent No.: US 7,222,595 B2
(45) Date of Patent: May 29, 2007

(54) INTERNAL COMBUSTION ENGINE FOR VEHICLE

(75) Inventors: Yutaka Inomoto, Wako (JP); Kosuke Tsunashima, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/039,052

(22) Filed: Jan. 20, 2005

(65) Prior Publication Data

US 2005/0166874 A1 Aug. 4, 2005

(30) Foreign Application Priority Data

Jan. 20, 2004 (JP) ..... 2004-012497

(51) Int. Cl.
*F01L 1/34* (2006.01)

(52) U.S. Cl. ..... 123/90.16; 123/90.11; 123/90.19; 123/90.38; 123/195 C; 123/41.31; 123/184.21; 440/88 C; 440/88 D; 440/89 R

(58) Field of Classification Search ..... 123/90.16, 123/90.11; 440/88 C, 88 D
See application file for complete search history.

(56) References Cited

U.S. PATENT DOCUMENTS 4,633,824 A 1/1987 Umeda et al.
6,045,421 A * 4/2000 Hiraoka et al. ..... 440/77
6,644,249 B2 * 11/2003 Itakura et al. ..... 123/41.31
6,679,204 B2 * 1/2004 Iida et al. ..... 123/90.11
6,814,042 B2 * 11/2004 Cutts et al. ..... 123/195 C

FOREIGN PATENT DOCUMENTS

| | | |
|---|---|---|
| GB | 613 387 | 11/1948 |
| JP | 61 167107 | 7/1986 |
| JP | 6 33758 | 2/1994 |
| JP | 8 135442 | 5/1996 |
| JP | 2002-155716 | 5/2002 |
| WO | WO 02/053893 | 7/2002 |

* cited by examiner

*Primary Examiner*—Thomas Denion
*Assistant Examiner*—Kyle M. Riddle
(74) *Attorney, Agent, or Firm*—Hamre, Schumann, Mueller & Larson PC

(57) ABSTRACT

A valve system of an internal combustion engine mounted on a vehicle comprises a valve characteristic varying mechanism for controlling valve operation characteristics of an engine valve, and an electric motor of the valve characteristic varying mechanism is disposed in the exterior of a valve chamber defined by the cylinder head. The cylinder head is provided with a duct, for guiding a running airflow therethrough, between a combustion chamber and the valve chamber. The electric motor is laid out at a position which is adjacent to the valve chamber in the radial direction with respect to the cylinder axis and at which the running airflow having flowed in via an inlet portion and having passed through the duct collides on the electric motor.

9 Claims, 14 Drawing Sheets

FIG 12A
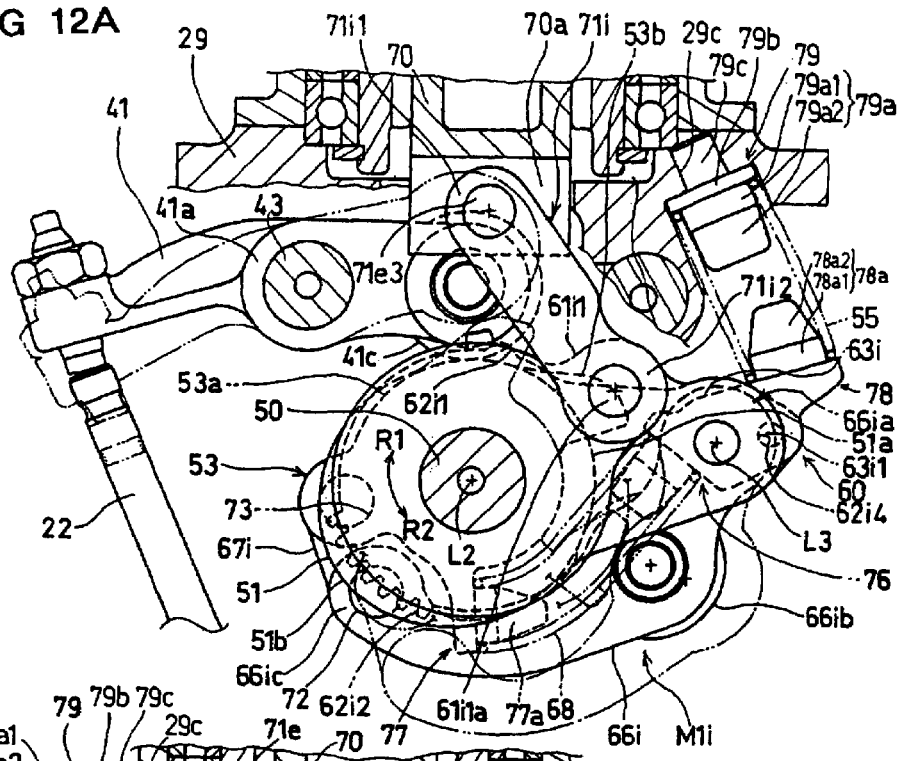
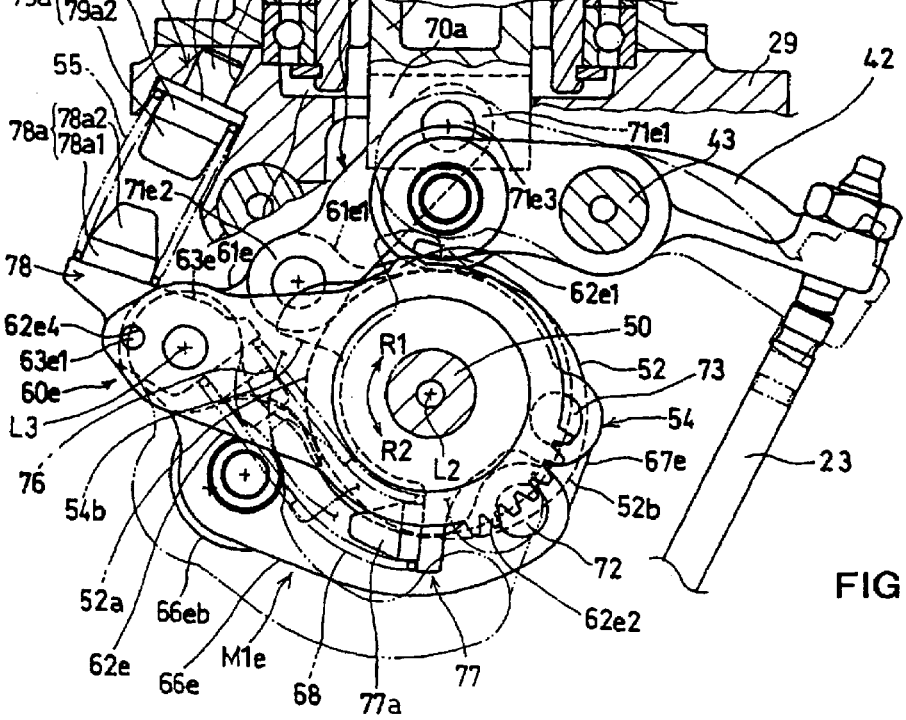
FIG 12B

FIG 13A
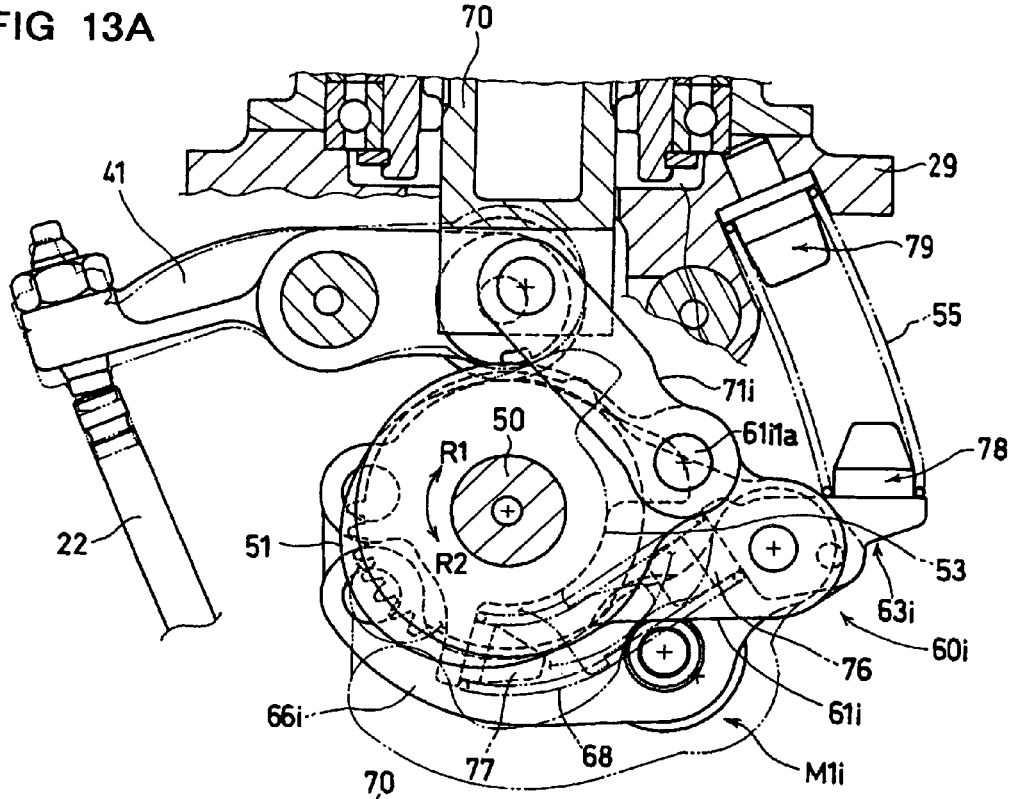
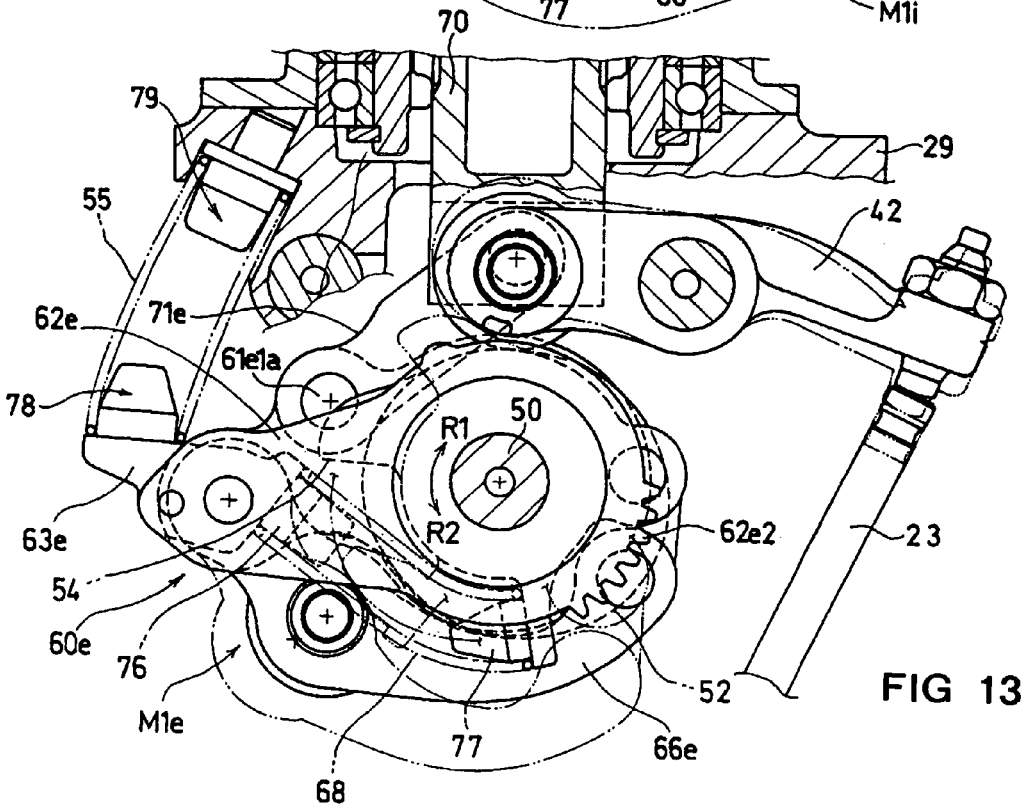
FIG 13B

FIG 14A
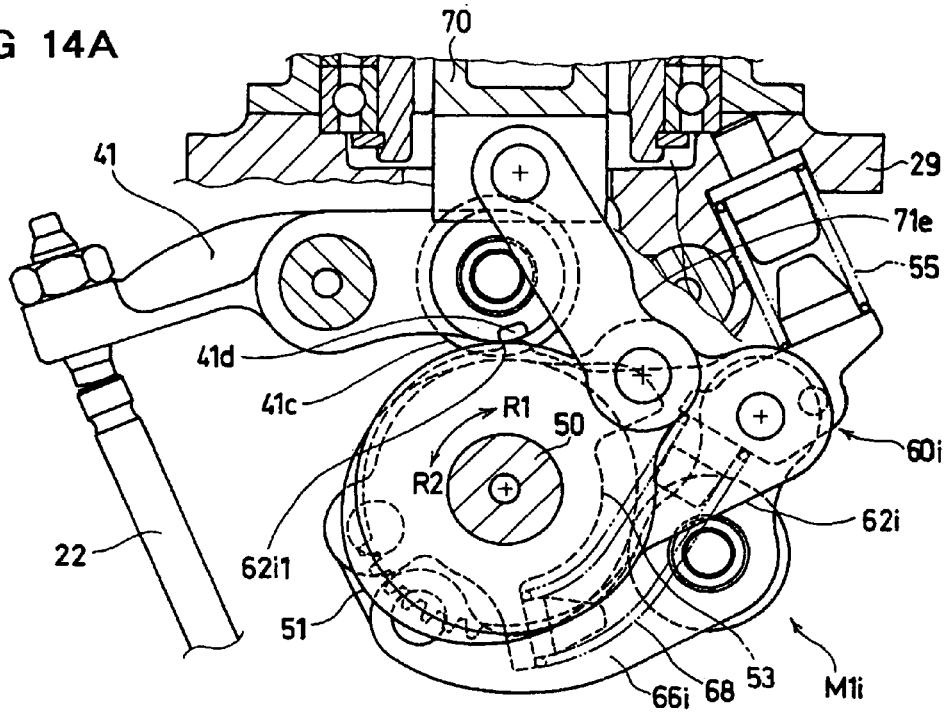
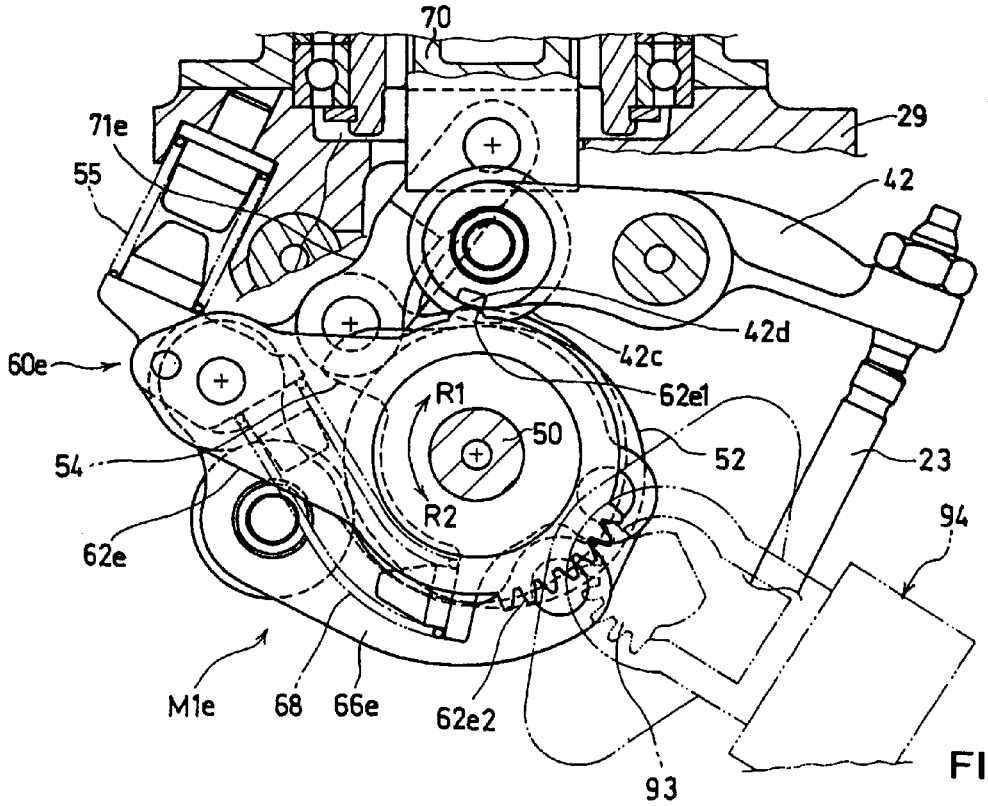
FIG 14B

INTERNAL COMBUSTION ENGINE FOR VEHICLE

FIELD OF THE INVENTION

The present invention relates to an internal combustion engine for a vehicle, which comprises a valve system comprising mechanism for controlling the valve operation characteristics by an electric actuator.

BACKGROUND OF THE INVENTION

A variable valve system for an internal combustion engine capable of changing the opening and closing timings and the maximum lift amount of an engine valve, is disclosed in JP 2002-155716. The valve system comprises a varying mechanism for controlling the valve lift amount of an intake valve put into an opening operation by a swing cam swingably supported on a drive shaft, and a drive mechanism having an electric motor for rotationally driving a control shaft of a control mechanism for controlling the operating position of the varying mechanism. The electric motor of the valve system is disposed at a rear end portion of a cylinder head with a plate therebetween and substantially in parallel to the control shaft. The drive shaft of the electric motor is disposed substantially in parallel to the drive shaft which is rotatably supported on the cylinder head and which is rotationally driven by the crankshaft.

The electric motor according to the above-mentioned Japanese reference is disposed on the exterior of the cylinder head and exposed to the outside air. Accordingly, the motor, is cooled by a process in which the heat generated by the operation thereof is released into the outside air. This arrangement ensures that accurate operations of the electric motor are secured, and the durability of the electric motor is enhanced. Meanwhile, in an internal combustion engine mounted on a vehicle, when it is intended to promote the cooling of the electric motor by utilizing the running airflow for the purpose of enhancing the performance of cooling by heat radiation, it is necessary to ensure that the collision of the running airflow on the electric motor is not hampered by the cylinder head itself or members disposed in the vicinity of the cylinder head. The limitation restricts the layout of the electric motor and makes it difficult to achieve a compact layout of the electric motor in relation to the cylinder head. When the electric motor is disposed at a tip end portion, in the cylinder axis direction, of a head cover connected to the cylinder head, the valve system comprising the electric motor is enlarged in size in the cylinder axis direction and, hence, the internal combustion engine comprising the valve system is enlarged in size in the cylinder axis direction.

SUMMARY OF THE INVENTION

The present invention has been made in consideration of the above-mentioned circumstances. It is an object of the inventions to enlarge the degree of freedom in laying out an electric actuator of a valve characteristic varying mechanism and to layout the electric actuator at the cylinder head in a compact form while securing good performance of cooling the electric actuator. It is another object to enhance the performance of cooling a combustion chamber wall and to prevent a valve chamber from being heated to a high temperature.

The invention relates to an internal combustion engine for a vehicle, mounted on the vehicle, comprising a cylinder head connected to a cylinder and defining a combustion chamber and a valve chamber, and a valve system comprising a valve characteristic varying mechanism for controlling valve operation characteristics of an engine valve comprised of an intake valve or an exhaust valve, with an electric actuator of the valve characteristic varying mechanism being disposed in the exterior of the valve chamber. The cylinder head is provided, between the combustion chamber and the valve chamber, with a duct for leading a running airflow therethrough, and the electric actuator is disposed at a position which is adjacent to the valve chamber in the radial direction with respect to the cylinder axis of the cylinder and at which the running airflow having passed through the duct collides against the electric actuator.

According to this, the airflow is guided by the duct formed in the cylinder head and collides against the electric actuator as a cooling airflow, thereby cooling the electric actuator. Therefore, it is unnecessary to lay out the electric actuator at such a position that the running airflow collides directly on the electric actuator, while avoiding the cylinder head itself or members disposed in the vicinity of the cylinder head. In addition, the duct can be formed so as to match the position of the electric actuator, and the electric actuator disposed adjacent to the valve chamber in the radial direction with respect to the cylinder axis can be laid out close to the cylinder head in the radial direction. Further, since the duct is formed between the combustion chamber and the valve chamber, the combustion chamber walls are cooled by the running airflow distributed through the duct, and the heating of the valve chamber by the heat coming from the combustion chamber is restrained.

The invention also relates to an internal combustion engine for a vehicle wherein the electric actuator comprises an output shaft extending in parallel to the cylinder axis. According to this, the electric actuator can be laid out along the cylinder axis, so that the electric actuator as a whole can be laid out closer to the cylinder axis, as compared with the case where the output shaft extends in parallel to a plane orthogonal to the cylinder axis.

Since the electric actuator is cooled by the running airflow guided by the duct, good performance of cooling the electric actuator is secured, and it is unnecessary to lay out the electric actuator at such a position that the running airflow collides directly on the electric actuator. In addition, the duct can be formed so as to match the position of the electric actuator, so that the degree of freedom in laying out the electric actuator is enhanced. Moreover, since the electric actuator can be disposed close to the cylinder head in the radial direction with respect to the cylinder axis, the electric actuator can be laid out at the cylinder head in a compact form, and it is possible to prevent the valve system from being enlarged in size in the cylinder axis direction and, hence, to prevent the internal combustion engine from being enlarged in size in the cylinder axis direction. Furthermore, the performance of cooling the combustion chamber walls is enhanced, and the valve chamber is prevented from being heated to a high temperature.

In addition to the effects of the invention as set forth in the cited claim. The electric actuator as a whole can be disposed close to the cylinder axis, so that the electric actuator can be disposed at the cylinder head in a compacter form in the radial direction.

BRIEF DESCRIPTION OF THE DRAWINGS

FIG. 12 shows the valve system for the internal combustion engine of FIG. 1, in which (A) is an illustration of an essential part of the valve characteristic varying mechanism when a maximum valve operation characteristic is obtained in regard of the intake valve, and (B) is an illustration of an essential part of the valve characteristic varying mechanism when a maximum valve operation characteristic is obtained in regard of the exhaust valve, corresponding to an essential part enlarged view of FIG. 2.

FIG. 13(A) is a view corresponding to FIG. 12(A) when a minimum valve operation characteristic is obtained in regard of the intake valve, and FIG. 13(B) is a view corresponding to FIG. 12(B) when a minimum valve operation characteristic is obtained in regard of the exhaust valve.

FIG. 14(A) is a view corresponding to FIG. 12(A) when a decompression operation characteristic is obtained in regard of the intake valve, and FIG. 14(B) is a view corresponding to FIG. 12(B) when a decompression operation characteristic is obtained in regard of the exhaust valve.

DETAILED DESCRIPTION OF THE INVENTION

Now, an embodiment of the present invention will be described below, referring to FIGS. 1 to 14.

Figure 1:
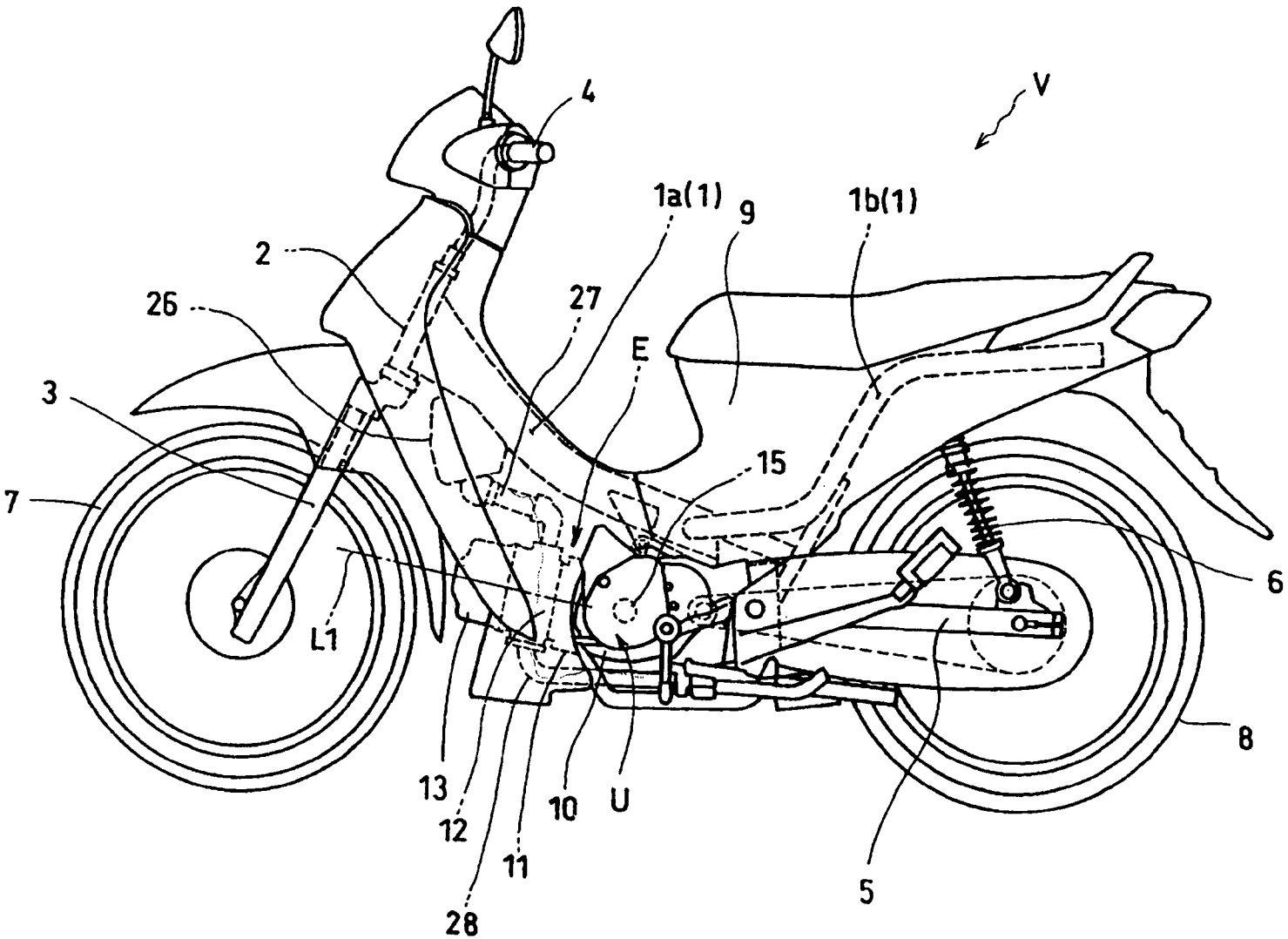
FIG. 1 is a general right side view of a motorcycle on which an internal combustion engine according to the present invention is mounted.

Referring to FIG. 1, an internal combustion engine E for a vehicle to which the present invention is applied is mounted on a motorcycle V representative of a vehicle. The motorcycle V comprises a vehicle body frame 1 having a front frame 1*a* and a rear frame 1*b*, a steering handle 4 fixed to an upper end portion of a front fork 3 rotatably supported on a head pipe 2 connected to the front end of the front frame 1*a*, a front wheel 7 rotatably supported on lower end portions of the front fork 3, a power unit U supported on the vehicle body frame 1, a rear wheel 8 rotatably supported on a rear end portion of a swing arm 5 swingably supported on the vehicle body frame 1, a rear cushion 6 for connection between the rear frame 1*b* and a rear portion of the swing arm 5, and a vehicle body cover 9 covering the vehicle body frame 1.

The power unit U comprises a transverse layout type internal combustion engine E having a crankshaft 15 extending in the left-right direction of the motorcycle V, and a power transmission device having a transmission and transmitting the power of the internal combustion engine E to the rear wheel 8. The internal combustion engine E comprises a crankcase 10 forming a crank chamber in which to contain the crankshaft 15 and serving also as a transmission case, a cylinder 11 connected to the crankcase 10 and extending forwards, a cylinder head 12 connected to a front end portion of the cylinder 11, and a head cover 13 connected to a front end portion of the cylinder head 12. The cylinder axis L1 of the cylinder 11 extends forwards, and either slightly upwards relative to the horizontal direction (see FIG. 1) or substantially in parallel to the horizontal direction. The rotation of the crankshaft 15 driven by a piston 14 (see FIG. 2) to rotate is transmitted to the rear wheel 8 through speed change by the transmission, to drive the rear wheel 8.

Figure 2:
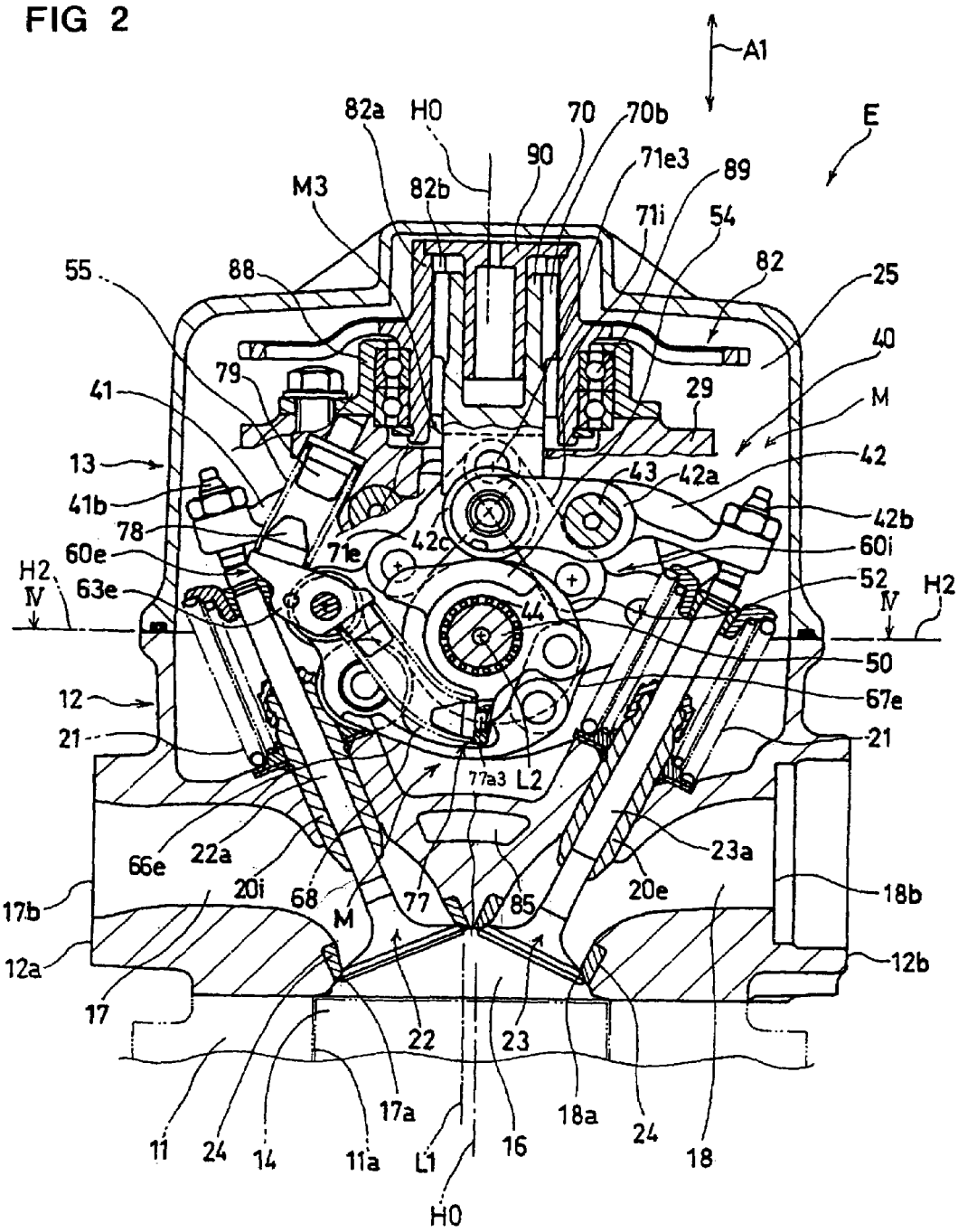
FIG. 2 is a sectional view, generally along arrow II—II of FIG. 4, of the internal combustion engine of FIG. 1, partly in section along a plane passing through the center axes of an intake valve and an exhaust valve and the center axis of a control shaft.

Referring to FIG. 2 also, the internal combustion engine E is an SOHC type air-cooled single-cylinder four-stroke internal combustion engine, in which the cylinder 11 is provided with a cylinder bore 11*a* in which the piston 14 is reciprocatably fitted, the cylinder head 12 is provided with a combustion chamber 16 on the side of facing the cylinder bore 11*a* in the cylinder axis direction A1, and further with an intake port 17 having an intake opening 17*a* opening into the combustion chamber 16 and an exhaust port 18 having an exhaust opening 18*a* opening into the combustion chamber 16. In addition, a spark plug 19 fronting on the combustion chamber 16 is inserted in a mount hole 12*c* formed in the cylinder head 12, to be mounted to the cylinder head 12. Here, the combustion chamber 16 constitutes a combustion space, together with the cylinder bore 11*a* between the piston 14 and the cylinder head 12.

Further, the cylinder head 12 is provided with one intake valve 22 and one exhaust valve 23 serving as engine valves which are reciprocatably supported by valve guides 20*i*, 20*e* and are each normally biased in the valve closing direction by a valve spring 21. The intake valve 22 and the exhaust valve 23 are put into opening and closing operations by a valve system 40 provided in the internal combustion engine E, to open and close the intake opening 17*a* and the exhaust opening 18*a* defined by valve seats 24. The valve system 40, exclusive of an electric motor 80 (see FIG. 3) is disposed in a valve chamber 25 defined by the cylinder head 12 and the head cover 13.

An intake system comprising an air cleaner 26 (see FIG. 1) and a throttle body 27 (see FIG. 1) is mounted to an upper surface 12*a*, i.e., one side surface of the cylinder head 12 in which an inlet 17*b* of the intake port 17 is opened, for leading air taken in from the exterior to the intake port 17. On the other hand, an exhaust system comprising an exhaust pipe 28 (see FIG. 1) for leading an exhaust gas flowing out from the combustion chamber 16 via the exhaust port 18 to the exterior of the internal combustion engine E is mounted a lower surface 12*b*, i.e., the other side surface of the cylinder head 12 in which an outlet 18*b* of the exhaust port 18 is opened. In addition, the intake system comprises a fuel injection valve which is a fuel supply device for supplying a liquid fuel into the intake air.

The air taken in through the air cleaner 26 and the throttle body 27 flows through the opened intake valve 22 to be taken into the combustion chamber 16 in the intake stroke in which the piston 14 is moved downwards, and the air thus taken in is compressed in the state of being mixed with the fuel in the compression stroke in which the piston 14 is moved upwards. The fuel-air mixture is combusted by ignition by the spark plug 19 at the final stage of the compression stroke, and the piston 14 driven by the pressure of the combustion gas, in the expansion stroke in which the piston 14 is moved downwards, drives the crankshaft 15 to rotate. In the exhaust stroke in which the piston 14 is moved upwards, the burned gas flows through the opened exhaust valve 23 to be discharged from the combustion chamber 16 into the exhaust port 18, as an exhaust gas.

Referring to FIGS. 2 to 5 and FIG. 10, the valve system 40 comprises an intake main rocker arm 41 as an intake cam follower abutting on a valve stem 22*a* of the intake valve 22 so as to put the intake valve 22 into opening and closing operations, an exhaust main rocker arm 42 as an exhaust cam follower abutting on a valve stem 23*a* of the exhaust valve 23 so as to put the exhaust valve 23 into opening and closing operations, and a valve characteristic varying mechanism M for controlling the valve operation characteristics including the opening and closing timings and the maximum lift amounts of the intake valve 22 and the exhaust valve 23.

The intake main rocker arm 41 and the exhaust main rocker arm 42 are rockably supported on a pair of rocker shafts 43 fixed to a camshaft holder 29 at fulcrum points 41*a*, 42*a* at central portions thereof, respectively, abut on the valve stems 22*a*, 23*a* at adjustment screws 41*b*, 42*b* constituting action portions at one-side end portions thereof, and make contact with an intake cam 53 and an exhaust cam 54 at rollers 41*c*, 42*c* constituting contact portions at other-side end portions thereof, respectively.

The valve characteristic varying mechanism M comprises an internal mechanism contained in the valve chamber 25, and the electric motor 80 which is an external mechanism disposed in the exterior of the valve chamber 25 and is an electric actuator for driving the internal mechanism. The internal mechanism comprises: one camshaft 50 rotatably supported on the cylinder head 12 and driven to rotate in conjunction with the crankshaft 15; an intake drive cam 51 and an exhaust drive cam 52 which are drive cams provided on the camshaft 50 and rotated integrally with the camshaft 50; link mechanisms Mli, Mle as interlocking mechanisms pivotally supported on the camshaft 50 and swingable about the camshaft 50; the intake cam 53 and the exhaust cam 54 which are valve cams connected to the link mechanisms Mli, Mle and pivotally supported on the camshaft 50 so as to operate the intake main rocker arm 41 and the exhaust main rocker arm 42, respectively; a drive mechanism M2 (see FIG. 3) comprising the electric motor 80 as a drive source for swinging the link mechanisms Mli, Mle about the camshaft 50; a control mechanism M3 interposed between the drive mechanism M2 and the link mechanisms Mli, Mle and controlling the swinging of the link mechanisms Mli, Mle about the camshaft 50 according to the drive force of the electric motor 80; and a pressing spring 55 as pressing energizing means for applying a torque about the camshaft 50 to the link mechanisms Mli, Mle for the purpose of pressing the link mechanisms Mli, Mle against the control mechanism M3.

Figure 3:
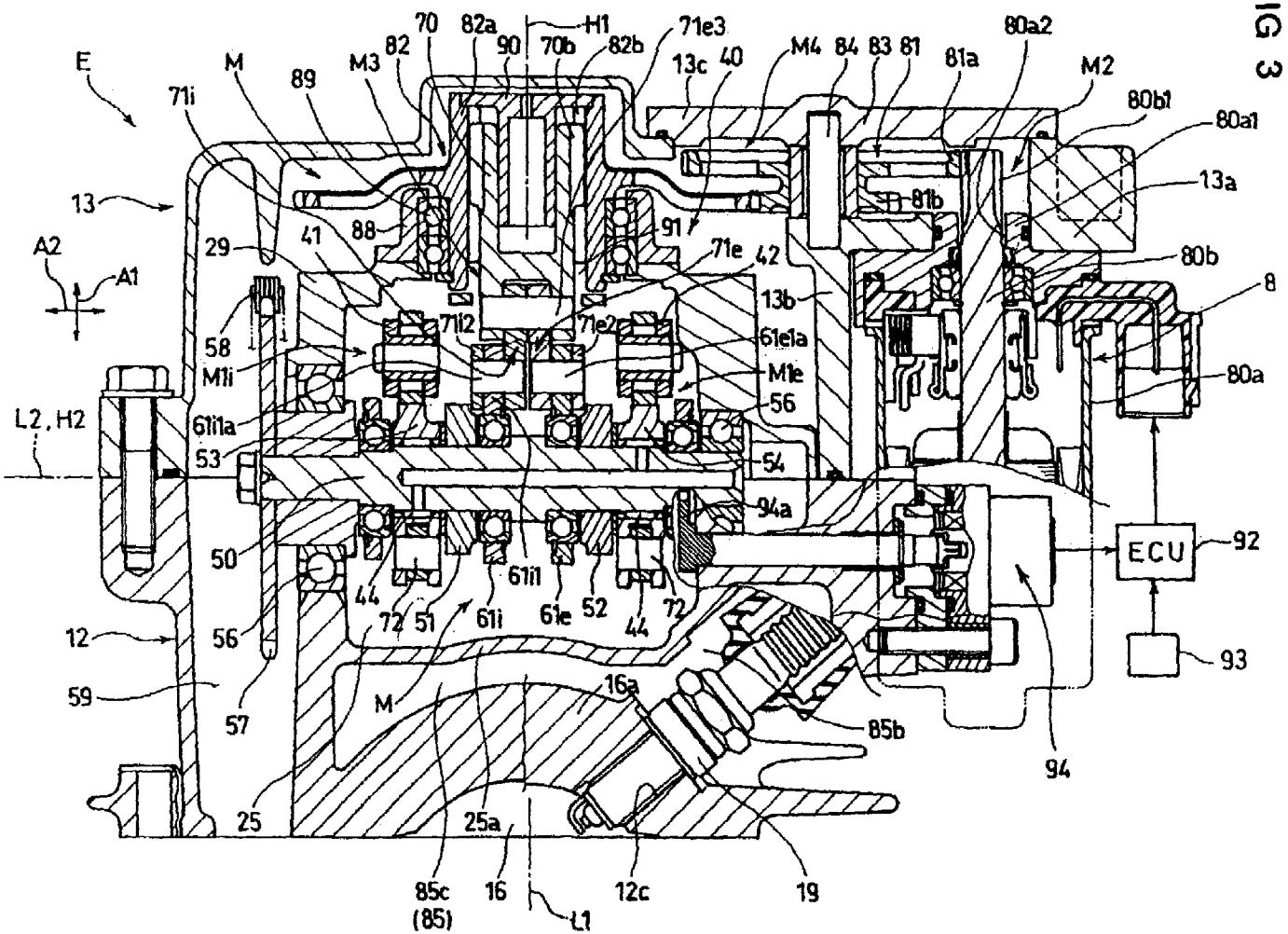
FIG. 3 is a sectional view, generally along arrow IIIa—IIIa of FIG. 8, of the internal combustion engine of FIG. 1, partly in section generally along arrow IIIb—IIIb.
Figure 4:
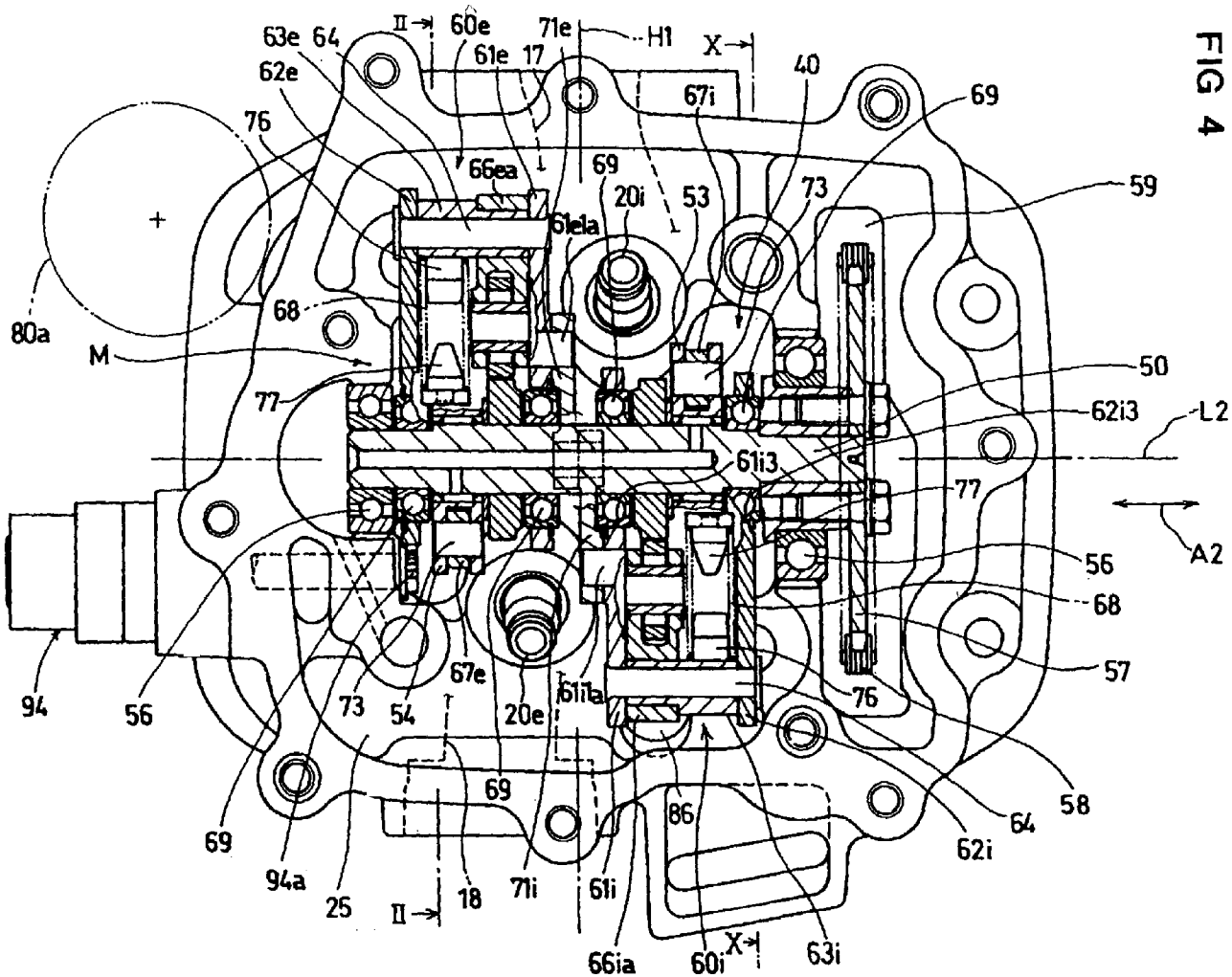
FIG. 4 is a sectional view, generally along arrow IV—IV of FIG. 2, of a valve system in the internal combustion engine of FIG. 1 with the head cover removed, partly with component members of the valve system in appropriate section.
Figure 5:
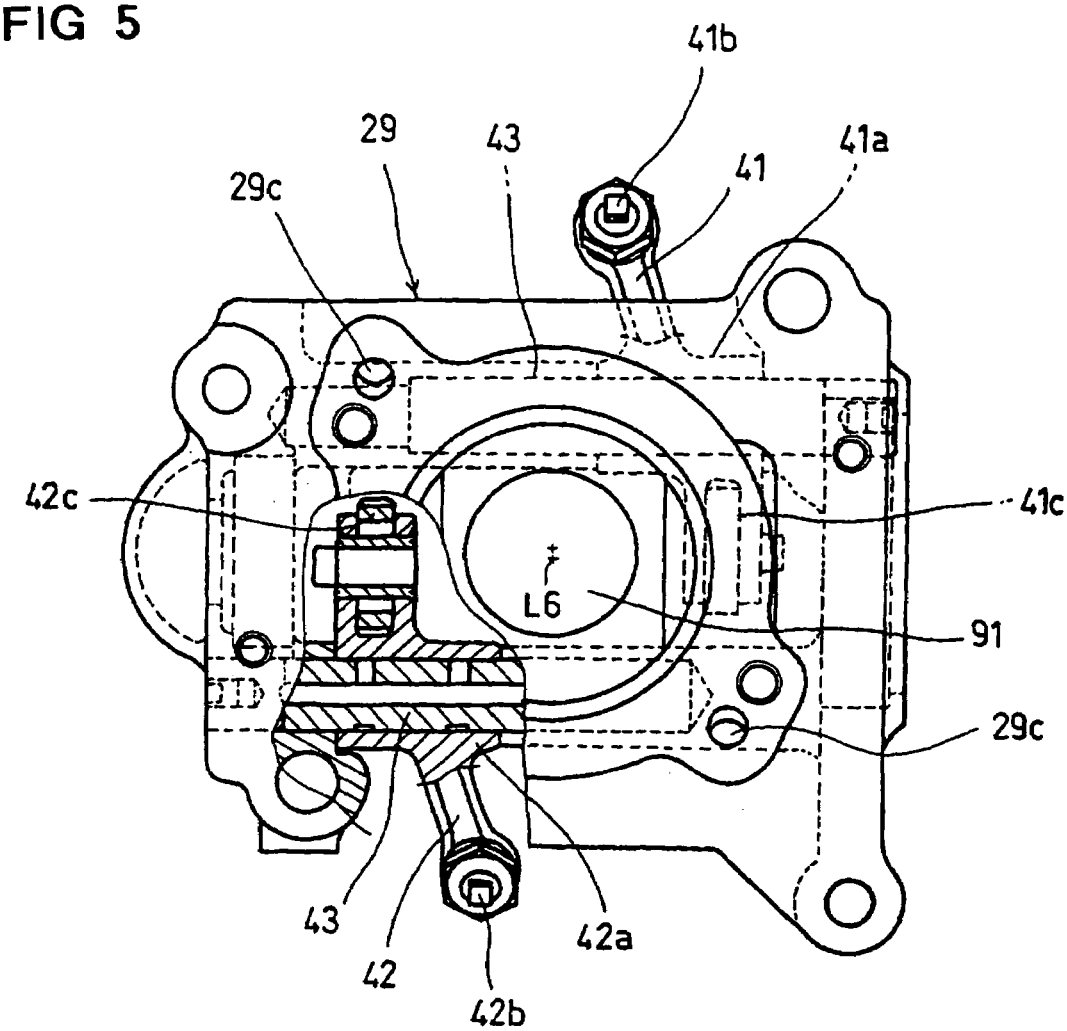
FIG. 5 is a view of a camshaft holder mounted to a cylinder head in the internal combustion engine of FIG. 1, as viewed along the cylinder axis from the head cover side.

Referring to FIGS. 2 to 4, the camshaft 50 is rotatably supported on the cylinder head 12 and a camshaft holder 29 connected to the cylinder head 12, through a pair of bearings 56 disposed at both end portions thereof, and is driven to rotate in conjunction with the crankshaft 15 (see FIG. 1) at a rotation speed of one half that of the crankshaft 15, by the power of the crankshaft 15 transmitted through a valve power transmission mechanism. The valve power transmission mechanism comprises a cam sprocket 57 integrally connected to a portion near the tip end of a left end portion, or one-side end portion, of the camshaft 50, a drive sprocket integrally connected to the crankshaft 15, and a timing chain 58 wrapped around the cam sprocket 57 and the drive sprocket. The valve power transmission mechanism is contained in a power transmission chamber which is defined by the cylinder 11 and the cylinder head 12 and is located on the left side, or one lateral side, in relation to a first orthogonal plane H1, of the cylinder 11 and the cylinder head 12. Of the power transmission chamber, a power transmission chamber 59 formed in the cylinder head 12 is adjacent to the valve chamber 25 in the radial direction with the cylinder axis L1 as a center (hereinafter referred to as "the radial direction") and in the direction A2 of the rotational center line L2 of the camshaft 50 (hereinafter referred to as "the camshaft direction A2"). Here, the first orthogonal plane H1 is a plane orthogonal to a reference plane H0 which includes the cylinder axis L1 and will be described later.

Incidentally, in the valve characteristic varying mechanism M, members relating to the intake valve 22 and members relating to the exhaust valve 23 include mutually corresponding members, and the intake drive cam 51, the exhaust drive cam 52, the link mechanisms Mli, Mle, the intake cam 53 and the exhaust cam 54 have the same basic structures; therefore, the following description will be centered on the members relating to the exhaust valve 23, and the members relating to the intake valve 22, related descriptions and the like will be parenthesized, if necessary.

Referring to FIGS. 2, 3, 6, 7 and 12, the exhaust drive cam 52 (intake drive cam 51) fixed by being press fitted to the camshaft 50 has a cam surface formed over the entire circumference of the outer circumferential surface thereof. The cam surface is composed of a base circle portion 52*a* (51*a*) for not swinging the exhaust cam 54 (intake cam 53) through the link mechanism Mle (Mli), and a cam crest portion 52*b* (51*b*) for swinging the exhaust cam 54 (intake cam 53) through the link mechanism Mle (Mli). The base circle portion 52*a* (51*a*) has an arcuate sectional shape with a fixed radius from the rotational center line L2, and the cam crest portion 52*b* (51*b*) has a sectional shape such that the radius from the rotational center line L2 increases and then decreases in the rotational direction R1 of the camshaft 50. The base circle portion 52*a* (51*a*) sets the swing position of the exhaust cam 54 (intake cam 53) so that the exhaust main rocker arm 42 (intake main rocker arm 41) makes contact with a base portion 54*a* (53*a*) of the exhaust cam 54 (intake cam 53), whereas the cam crest portion 52*b* (51*b*) sets the swing position of the exhaust cam 54 (intake cam 53) so that the exhaust main rocker arm 42 (intake main rocker arm 41) makes contact with the base circle portion 54*a* (53*a*) and the cam crest portion 54*b* (53*b*) of the exhaust cam 54 (intake cam 53).

The link mechanisms Mli, Mle are constituted of the intake link mechanism Mli connected to the intake cam 53, and the exhaust link mechanism Mle connected to the exhaust cam 54. Referring to FIG. 4 also, the exhaust link mechanism Mle (intake link mechanism Mli) comprises a holder 60*e* (60*i*) pivotally supported on the camshaft 50 and swingable about the camshaft 50, an exhaust sub rocker arm 66*e* (intake sub rocker arm 66*i*) pivotally supported on the holder 60*e* (60*i*) and driven by the exhaust drive cam 52 (intake drive cam 51) to swing, a connection link 67*e* (67*i*) pivotally supported on the exhaust sub rocker arm 66*e* (intake sub rocker arm 66*i*) at one end portion thereof and pivotally supported on the exhaust cam 54 (intake cam 53) at the other end portion thereof, and a control spring 68 for pressing the exhaust sub rocker arm 66*e* (intake sub rocker arm 66*i*) against the exhaust drive cam 52 (intake drive cam 51).

Figure 6A:
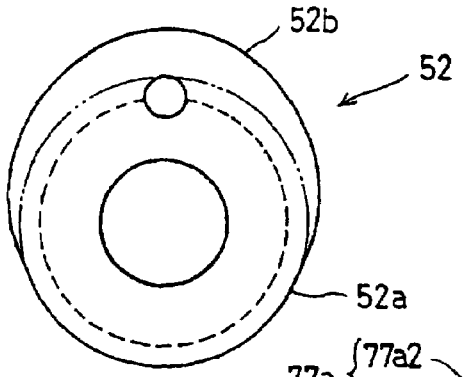
FIG. 6 shows the valve system for the internal combustion engine of FIG. 1, in which (A) is a view of an exhaust drive cam of a valve characteristic varying system as viewed in the camshaft direction, and (B) is a view of an exhaust link mechanism and an exhaust cam in the valve characteristic varying mechanism in an appropriately pivotally moved condition.
Figure 6B:
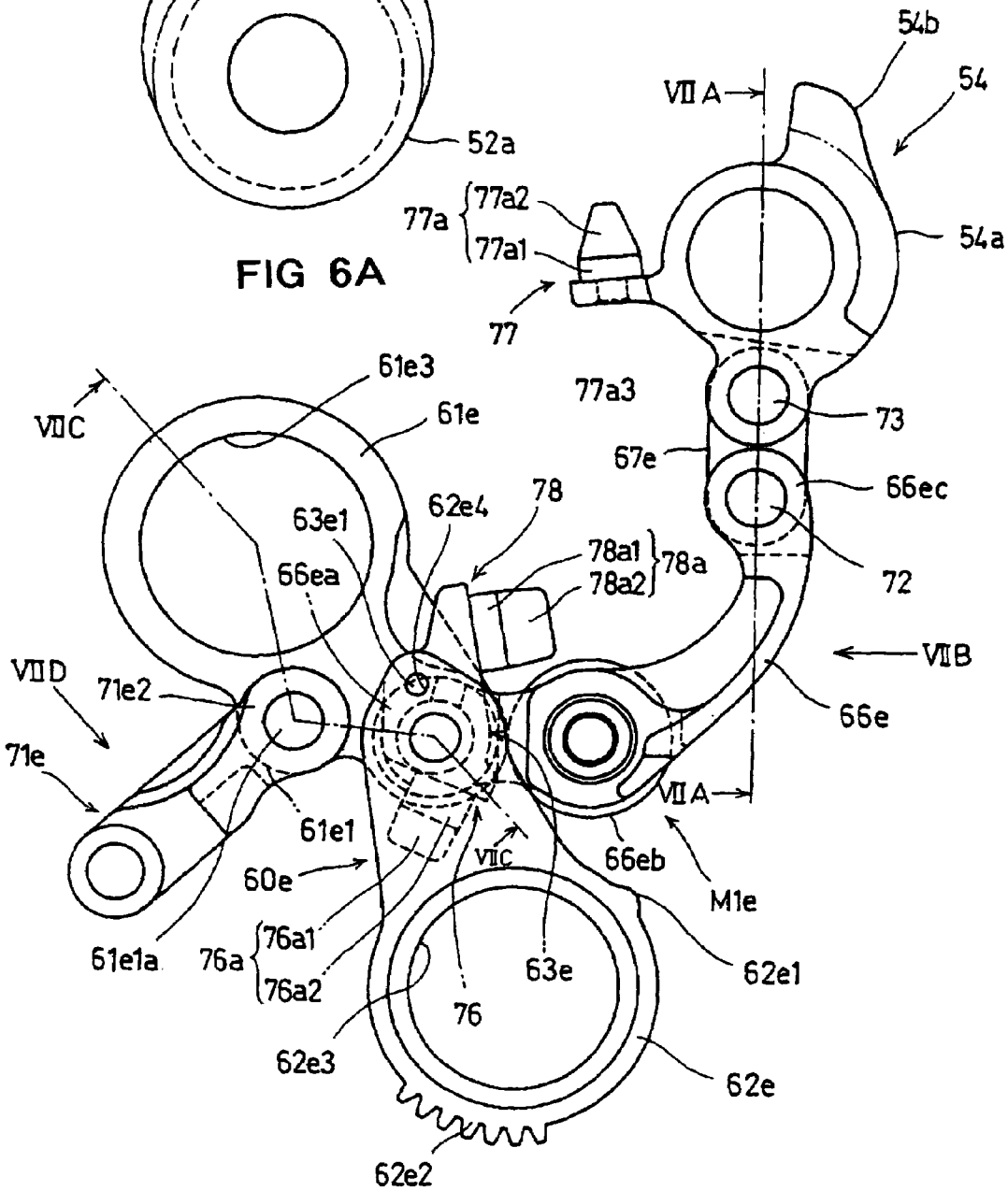
Figure 7A:
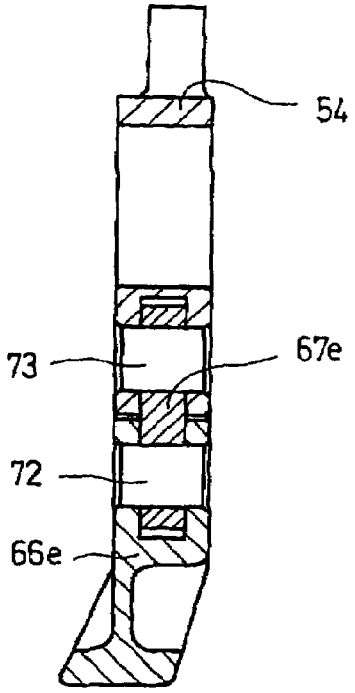
FIG. 7(A) is a sectional view along arrow VIIA of FIG. 6.
Figure 7B:
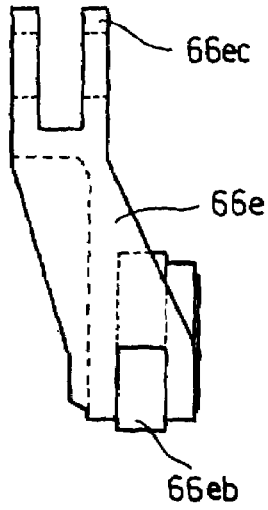
FIG. 7(B) is a view along arrow VIIB of FIG. 6.
Figure 7C:
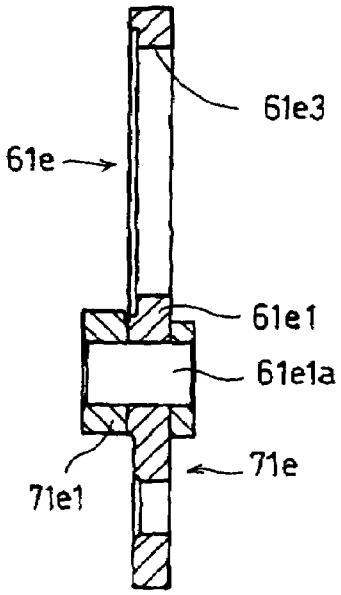
FIG. 7(C) is a sectional view along arrow VIIC of FIG. 6.
Figure 7D:
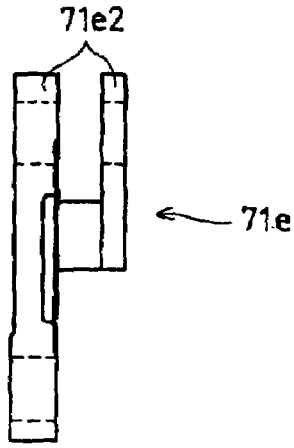
FIG. 7(D) is a view along arrow VIID of FIG. 6.

The holder 60*e* (60*i*) supported on the camshaft 50 through a bearing 69 in which the camshaft 50 is inserted comprises a pair of first and second plates 61*e* (61*i*), 62*e* (62*i*) spaced from each other in the camshaft direction A2, and a connection member for connecting the first plate 61*e* (61*i*) and the second plate 62*e* (62*i*) to each other at a predetermined interval in the camshaft direction A2 and for pivotally supporting the exhaust sub rocker arm 66*e* (intake sub rocker arm 66*i*). The connection member comprises a collar 63*e* (63*i*) determining the predetermined interval between both the plates 61*e* (61*i*), 62*e* (62*i*) and serving also as a support shaft for pivotally supporting the exhaust sub rocker arm 66*e* (intake sub rocker arm 66*i*), and a rivet 64 inserted in the collar 63*e* (63*i*) to integrally connect both the plates 61*e* (61*i*), 62*e* (62*i*) to each other. As shown in FIGS. 4 and 6, the plates 61*e* (61*i*), 62*e* (62*i*) are provided with mount holes 61*e*3 (61*i*3), 62*e*3 (62*i*3) in which to mount bearings 69 for swingably supporting the plates 61*e* (61*i*), 62*e* (62*i*) on the camshaft 50.

Referring to FIG. 3 also, an exhaust control link 71*e* (intake control link 71*i*) of the control mechanism 3 is pivotally mounted to the first plate 61*e* (61*i*), and the exhaust control link 71*e* (intake control link 71*i*) and the first plate 61*e* (61*i*) are so connected as to be capable of relative motions at their connection portions 71*e*2 (71*i*2), 61*e*1 (61*i*1). Specifically, a connection pin 61*e*1*a* (61*i*1*a*) fixed by being press fitted in a hole in the connection portion 61*e*1 (61*i*1) of the first plate 61*e* (61*i*) serving as a holder side connection portion is relatively rotatably inserted in a hole in the connection portion 71*e*2 (71*i*2) of the exhaust control link 71*e* (intake control link 71*i*) serving as a control mechanism side connection portion.

In addition, the second plate 62*e* (62*i*) is provided with a decompression cam 62*e*1 (62*i*1) (see FIGS. 6 and 12) for facilitating the starting by lowering the compression pressure through slightly opening the intake valve 22 and the exhaust valve 23 in the compression stroke at the time of starting the internal combustion engine E. Further, the second plate 62*e* is provided with a detected portion 62*e*2 to be detected by a detecting portion 94*a* of the swing position detection means 94 (see FIGS. 3 and 14). The detected portion 62*e*2 is composed of a teeth portion engaged in the swinging direction of the second plate 62*e* by being meshed with a teeth portion constituting the detecting portion 94*a*. Incidentally, though not used in this embodiment, the second plate 61*i* is also provided with a portion 62*i*2 corresponding to the detected portion 62*e*2.

The collar 63*e* (63*i*) is integrally provided with a first spring holding portion 76 for holding one end portion of a control spring 68 consisting of a compression coil spring having a straight hollow cylindrical shape in the natural state, and a movable side spring holding portion 78 for holding one end portion of the pressing spring 55 consisting of a compression coil spring having a straight hollow cylindrical shape in the natural state. Both the spring holding portions 76, 78 are disposed adjacently to a fulcrum portion 66*ea* (66*ia*) of the exhaust sub rocker arm 66*e* (intake sub rocker arm 66*i*) in the camshaft direction A2 and are disposed at an interval along the circumferential direction of the collar 63*e* (63*i*) (see FIG. 4).

In addition, the collar 63*e* (63*i*) is provided, at a position spaced from the swing center line L3 of the exhaust sub rocker arm 66*e* (intake sub rocker arm 66*i*), with a projected portion 63*e*1 (63*i*1) to be fitted in a hole 62*e*4 (62*i*4) formed in the second plate 62*e* (62*i*). The projected portion 63*e*1 (63*i*1) and the hole 62*e*4 (62*i*4) constitute an engagement portion for inhibiting relative rotations, around the swing center line L3, of the second plate 62*e* (62*i*) and the collar 63*e* (63*i*). By the engagement portion, the pair of spring holding portions 76, 78 are provided, whereby the collar 63*e* (63*i*) on which torques in the same direction are exerted by the spring forces of the control spring 68 and the pressing spring 55 is inhibited from relative rotation relative to the first and second plates 61*e* (61*i*), 62*e* (62*i*), so that the application of torques about the camshaft 50 to the link mechanisms Mli, Mle by the pressing spring 55 and the pressing thereof against the exhaust drive cam 52 (intake drive cam 51) by the control spring 68 are performed assuredly.

Referring to FIGS. 2 to 4, 6, 7 and 12, in the camshaft direction A2, the exhaust sub rocker arm 66*e* (intake sub rocker arm 66*i*) disposed between the first and second plates 61*e* (61*i*), 62*e* (62*i*) together with the exhaust cam 54 (intake cam 53) and the exhaust drive cam 52 (intake drive cam 51) makes contact with the exhaust drive cam 52 (intake drive cam 51) at a roller 66*eb* (66*ib*) serving as a contact portion for contact with the exhaust drive cam 52 (intake drive cam 51), is swingably supported on the collar 63*e* (63*i*) at the fulcrum portion 66*ea* (66*ia*) at one end portion thereof, and is pivotally supported on a connection pin 72 fixed to one end portion of the connection link 67*e* (67*i*) at the other end portion thereof. Therefore, the exhaust sub rocker arm 66*e* (intake sub rocker arm 66*i*) is swung about the collar 63*e* (63*i*) due to the rotation of the exhaust drive cam 52 (intake drive cam 51) together with the camshaft 50.

The exhaust cam 54 (intake cam 53) pivotally supported on a connection pin 73 fixed to the other end portion of the connection link 67*e* (67*i*) is composed of a swing cam supported on the camshaft 50 through the bearing 44 and thereby swingable about the camshaft 50, and is provided with a cam surface at a part of the outer circumferential surface thereof. The cam surface is composed of the base circle portion 54*a* (53*a*) for maintaining the exhaust valve 23 (intake valve 22) in the closed state, and the cam crest portion 54*b* (53*b*) for pressing down and thereby opening the exhaust valve 23 (intake valve 22). The base circle portion 54*a* (53*a*) has an arcuate sectional shape with a fixed radius from the rotational center line L2, whereas the cam crest portion 54*b* (53*b*) has such a sectional shape that the radius from the rotational center line L2 increases along the counter-rotational direction R2 (rotational direction R1) of the camshaft 50. Therefore, the cam crest portion 54*b* (53*b*) of the exhaust cam 54 (intake cam 53) has such a shape that the lift amount of the exhaust valve 23 (intake valve 22) gradually increases along the counter-rotational direction R2 (rotational direction R1).

The exhaust cam 54 (intake cam 53), on one hand, is swung about the camshaft 50 together with the exhaust link mechanism Mle (intake link mechanism Mli) by the same swing amount, by the drive force of the drive mechanism M2 transmitted through the control mechanism M3, and, on the other hand, is swung about the camshaft 50 by the exhaust sub rocker arm 66*e* (intake sub rocker arm 66*i*) swung by the exhaust drive cam 52 (intake drive cam 51). The exhaust cam 54 (intake cam 53) swung relative to the camshaft 50 swings the exhaust main rocker arm 42 (intake main rocker arm 41), thereby putting the exhaust valve 23 (intake valve 22) into opening and closing operations. Therefore, the exhaust cam 54 (intake cam 53) is swung by the drive force of the drive mechanism M2 transmitted sequentially through the holder 60*e* (60*i*), the exhaust sub rocker arm 66*e* (intake sub rocker arm 66*i*) and the connection link 67*e* (67*i*), and is swung by the drive force of the exhaust drive cam 52 (intake drive cam 51) transmitted sequentially through the exhaust sub rocker arm 66*e* (intake sub rocker arm 66*i*) and the connection link 67*e* (67*i*).

The control spring 68 for generating a spring force for pressing the roller 66*eb* (66*ib*) of the exhaust sub rocker arm 66*e* (intake sub rocker arm 66*i*) against the exhaust drive cam 52 (intake drive cam 51) is disposed between the collar 63*e* (63*i*) and the exhaust cam 54, and can be extended and contracted in the circumferential direction of the camshaft 50 according to the rocking of the exhaust sub rocker arm 66*e* (intake sub rocker arm 66*i*). One end portion of the control spring 68 is held by the first spring holding portion 76, and the other end portion is held by a second spring holding portion 77 provided at a shelf-like projected portion which is integrally formed on the exhaust cam 54 (intake cam 53).

The pressing spring 55 normally exerting on the exhaust link mechanism Mle (intake link mechanism Mli) a spring force for applying a torque directed in one sense of the swinging direction has its one end portion held by the movable side spring holding portion 78 of the holder 60*e* (60*i*), and has its other end portion held by a fixed side spring holding portion 79 provided in the camshaft holder 29 which is a fixed member fixed to the cylinder head 12.

The spring force of the pressing spring 55 for pressing the exhaust link mechanism Mle (intake link mechanism Mli) toward the side of the cylinder 11 acts directly on the holder 60*e* (60*i*) to press the holder 60*e* (60*i*) in the direction toward the cylinder 11, and the torque exerted on the holder 60*e* (60*i*) by the spring force is directed in the above-mentioned one sense. The one sense is set to be the same as the sense of the torque exerted on the exhaust cam 54 (intake cam 53) by the reaction force applied to the exhaust cam 54 (intake cam 53) from the exhaust valve 23 (intake valve 22) when the exhaust cam 54 (intake cam 53) opens the exhaust valve 23 (intake valve 22). Therefore, the sense in which the spring force of the pressing spring 55 normally presses the connection portion 61*e*1 (61*i*1) against the connection portion 71*e*2 (71*i*2) in the swinging direction is the same as the sense in which the above-mentioned reaction force presses the connection portion 61*e*1 (61*i*1) against the connection portion 71*e*2 (71*i*2) in the swinging direction, based on the torque applied from the exhaust cam 54 (intake cam 53) to the holder 60*e* (60*i*) through the connection link 67*e* (67*i*) and the exhaust sub rocker arm 66*e* (intake sub rocker arm 66*i*).

At the connection portions 71*e*2 (71*i*2), 61*e*1 (61*i*1) provided with slight gap due to the pivotal supporting, the connection portion 61*e*1 (61*i*1) on one side is normally pressed against the connection portion 71*e*2 (71*i*2) in the swinging direction by the pressing spring 55; therefore, when the first plate 61*e* (61*i*) is swung by the exhaust control link 71*e* (intake control link 71*i*), the influence of the gap (play) between the connection portion 71*e*2 (71*i*2) and the connection portion 61*e*1 (61*i*1) is eliminated, and the motion of the exhaust control link 71*e* (intake control link 71*i*) is accurately transmitted to the holder 60*e* (60*i*).

Here, referring to FIGS. 2, 4, 6 and 12, the spring holding portions 76, 77, 78, 79 will be further described. The spring holding portions 76, 77, 78, 79 have spring guides 76*a*, 77*a*, 78*a*, 79*a* which are each inserted into an end portion of the control spring 68 or an end portion of the pressing spring 55. The spring guides 76*a*, 77*a*, 78*a*, 79*a* have the same basic structure in the point of having base portions 76*a*1, 77*a*1, 78*a*1, 79*a*1 and tapered portions 76*a*2, 77*a*2, 78*a*2, 79*a*2, respectively. The base portions 76*a*1, 77*a*1, 78*a*1, 79*a*1 are each a portion over which the end portion of the control spring 68 or the pressing spring 55 is fitted in the state of being inhibited from moving in the radial direction, and the tapered portions 76*a*2, 77*a*2, 78*a*2, 79*a*2 are continuous with the base portions 76*a*1, 77*a*1, 78*a*1, 79*a*1 and are each tapered so as to obviate interference with the control spring 68 or the pressing spring 55 when the control spring 68 or the pressing spring 55 is curved and when the control spring 68 or the pressing spring 55 is in a substantially straight hollow cylindrical shape, due to the rocking of the exhaust sub rocker arm 66*e* (intake sub rocker arm 66*i*) or the swinging of the holder 60*e* (60*i*).

In this embodiment, the base portions 76*a*1, 77*a*1 of the spring guide 76*a*, 77*a* of the first and second spring holding portions 76, 77 are cylindrical, and have outside diameters roughly equal to or slightly greater than the inside diameter of the control spring 68. The tapered portions 76*a*2, 77*a*2 are in a straight truncated conical shape with a bottom portion having an outside diameter equal to the base portions 76*a*1, 77*a*1, and the outside diameter thereof decreases in the direction from the bas end portion 76*a*1, 77*a*1 toward the tip end. The degree of the taper of both the tapered portions 76*a*2, 77*a*2 is so set as to avoid interference with the control spring 68 when the control spring 68 is extended and simultaneously curved according to the rocking of the exhaust sub rocker arm 66*e* (intake sub rocker arm 66*i*) and when the control spring 66 is most contracted into a substantially straight hollow cylindrical shape.

The second spring holding portion 77 comprises the spring guide 77*a* having a mount portion 77*a*3, in addition to the base portion 77*a*1 and the tapered portion 77*a*2 having the same functions as those in the first spring holding portion 76. The spring guide 77*a* is fixed to the exhaust cam 54 (intake cam 53) by inserting the mount portion 77*a*3 into a hole in the projected portion mentioned above and then plastically deforming the mount portion 77*a*3 by caulking. In addition, the heights of the spring guides 76*a*, 77*a* from respective receiving surfaces of the first and second spring holding portions 76, 77 are nearly equal in this embodiment, but they may be set to be different, taking into account the strength of the control spring 68 or the like.

Besides, when the control spring 68 is curved due to the rocking of the exhaust sub rocker arm 66*e* (intake sub rocker arm 66*i*), the curvature of curving near the spring guide 77*a* of the second spring holding portion 77 which is the movable side spring holding portion movable relative to the first spring holding portion 76 is greater than the curvature of curving near the spring guide 76*a* of the first spring holding portion 76 which is the fixed side spring holding portion. Therefore, the degree of tapering of the tapered portion 77*a*2 is set to be greater than that of the tapered portion 76*a*2, and, in this embodiment, the apex angle of the cone determining the conical surface of the tapered portion 77*a*2 is set to be smaller.

On the other hand, the base portions 78*a*1, 79*a*1 of the spring guide 78*a*, 79*a* of the movable side and fixed side spring holding portions 78, 79 are in a cylindrical shape with an outside diameter nearly equal to or slightly greater than the inside diameter of the pressing spring 55. The tapered portions 78*a*2, 79*a*2 are each in a truncated conical shape with a bottom portion having an outside diameter equal to the base portion 78*a*1, 79*a*1, and the outside diameter thereof decreases in the direction from the base portion 78*a*1, 79*a*1 toward the tip end. The degree of tapering of both the tapered portions 78*a*2, 79*a*2 is so set as to avoid interference with the pressing spring 55 when the pressing spring 55 is extended and simultaneously curved according to the swinging of the holder 60*e* (60*i*) and when the pressing spring 55 is most contracted into a substantially straight hollow cylindrical shape.

The fixed side spring holding portion 79 comprises, in an integral form, the spring guide 79*a* having a base portion 79*a*1 and the tapered portion 79*a*2 similar to those of the movable side spring holding portion 78, a flange portion 79*b* having a receiving surface on which the pressing spring 55 abuts, and a mount portion 79*c*. The fixed side spring holding portion 79 is fixed to the camshaft holder 29 by press fitting of its mount portion 79*c* into a hole 29*c* (see FIG. 5 also) in the camshaft holder 29. Besides, the heights of the spring guides 78*a*, 79*a* from respective receiving surfaces of the movable side and fixed side spring holding portions 78, 79 are nearly equal in this embodiments, but they may be set to be different, taking into account the strength of the pressing spring 55 or the like.

When the pressing spring 55 is curved due to the swinging of the holder 60*e* (60*i*) of the exhaust link mechanism Mle (intake link mechanism Mli), the curvature of curving near the spring guide 78*a* of the movable side spring holding portion 78 moved relative to the fixed side spring holding portion 79 is greater than the curvature of curving near the spring guide 79*a* of the fixed side spring holding portion 79. Therefore, the degree of tapering of the tapered portion 78*a*2 is set to be greater than that of the tapered portion 79*a*2, and, in this embodiment, the apex angle of the cone determining the conical surface of the tapered portion 78*a*2 is set to be smaller.

In the condition where the first and second spring holding portions 76, 77 are closest to each other, the control spring 68 assumes a substantially straight hollow cylindrical shape (see FIGS. 12 and 13), and, in the condition where the movable side and fixed side spring holding portions 78, 79 are closest to each other, the pressing spring 55 assumes a substantially straight hollow cylindrical shape (see FIG. 14).

Referring to FIGS. 2, 3 and 12, the control mechanism M3 comprises a hollow cylindrical control shaft 70 as a control member driven by the drive mechanism M2, and control links 71*i*, 71*e* for transmitting the motion of the control shaft 70 to the link mechanisms Mli, Mle to thereby swing the link mechanisms Mli, Mle about the camshaft 50.

The control shaft 70 is movable in parallel to the cylinder axis L1, i.e., movable in parallel to the reference plane H0 which includes the rotational center line L2 and is parallel to the cylinder axis L1.

The control links 71*i*, 71*e* are constituted of the intake control link 71*i* and the exhaust control link 71*e*. The intake control link 71*i* is pivotally supported on the control shaft 70 at a connection portion 71*i*1 serving as a first intake connection portion, and is pivotally supported on the connection portion 61*i*1 of the first plate 61*i* of the intake link mechanism Mli at a connection portion 71*i*2 serving as a second intake connection portion. The exhaust control link 71*e* is pivotally supported on the control shaft 70 at a connection portion 71*e*1 serving as a first exhaust connection portion, and is pivotally supported on the connection portion 61*e*1 of the first plate 61*e* of the exhaust link mechanism Mle at a connection portion 71*e*2 serving as a second exhaust connection portion. The connection portion 71*i*1 of the intake control link 71*i* and the connection portion 70*a* of the control shaft 70 each have a hole into which one connection pin 71*e*3 fixed by being press fitted into a hole in the connection portion 71*e*1 of the exhaust control link 71*e* is relatively rotatably inserted, and are pivotally supported on the connection pin 71*e*3, whereas the bifurcated connection portions 71*i*2, 71*e*2 (see FIG. 7(D)) have holes into which connection pins 61*i*1*a*, 61*e*1*a* of the connection portions 71*i*2, 71*e*2 are relatively rotatably inserted, and they are pivotally supported on the connection pins 61*i*1*a*, 61*e*1*a*, respectively. At the connection portions 71*e*1 (71*i*1), 70*a* provided with slight gap due to the pivotal supporting, the connection portion 71*e*1 (71*i*1) is normally pressed against the connection portion 70*a* by the spring force of the pressing spring, so that the influence of the gap (play) between the connection portion 71*e*1 (71*i*1) and the connection portion 70*a* is eliminated, and the motion of the control shaft 70 is accurately transmitted to the exhaust control link 71*e* (intake control link 71*i*).

Figure 8:
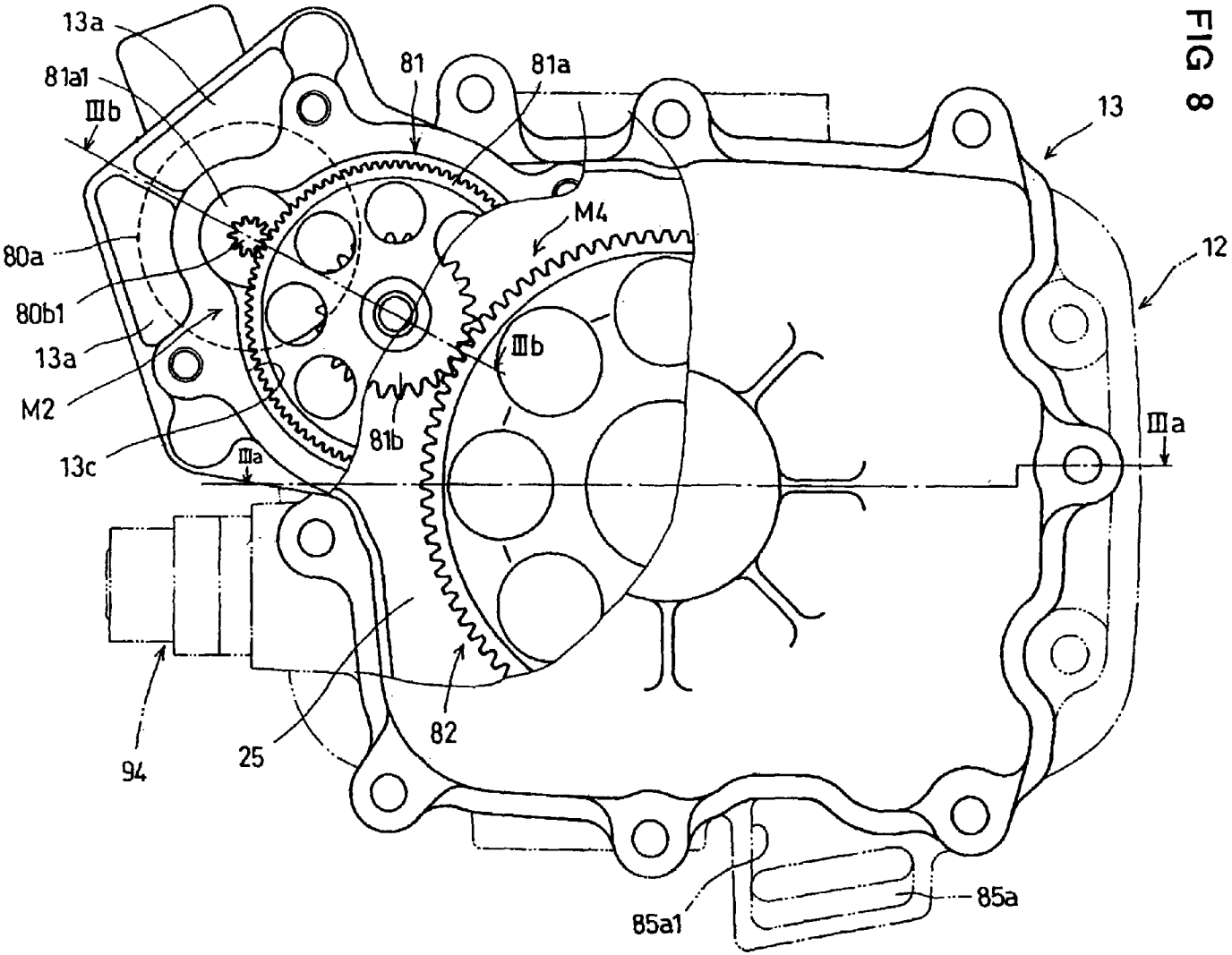
FIG. 8 is a view of the head cover in the internal combustion engine of FIG. 1 as viewed along the cylinder axis from the front side, with a drive mechanism of the valve characteristic varying mechanism shown in partly broken state.

Referring to FIGS. 3 and 8, the drive mechanism M 2 for driving the control shaft 70 comprises an electric motor 80 capable of reverse rotation and mounted to the head cover 13, and a transmission mechanism M4 for transmitting the rotation of the electric motor 80 to the control shaft 70. The control mechanism M3 and the drive mechanism M2 are disposed on the opposite side of the cylinder 11 and the combustion chamber 16, with respect to a second orthogonal plane H2 which includes the rotational center line L2 and is orthogonal to the reference plane H0.

The electric motor 80 comprises a hollow cylindrical main body 80*a* in which a heating portion such as a coil portion is contained and which has a center axis parallel to the cylinder axis L1, and an output shaft 80*b* extending in parallel to the cylinder axis L1. The electric motor 80 is disposed on the outer side in the radial direction of the valve chamber 25, in relation to the cylinder head 12 and the head cover 13. The power transmission chamber 59 and an inlet portion 85*a* (described later) are disposed on the left side of the first orthogonal plane H1, and the main body 80*a*, the spark plug 19 and an outlet portion 85*b* (described later) are disposed on the right side, i.e. the other side, of the first orthogonal plane H1. In the main body 80*a*, a mounted portion 80*a*1 to be connected to a mount portion 13*a* formed in an eaves-like shape on the head cover 13 to project in the radial direction is provided with a through-hole 80*a*2, and the output shaft 80*b* penetrates through the through-hole 80*a*2 to project to the exterior of the main body 80*a* and extends into the valve chamber 25. The main body 80*a* is disposed at such a position that the whole part thereof is covered by the mount portion, as viewed in the cylinder axis direction A1 from the side of the head cover 13, or as viewed from the front side of the head cover 13 (see FIG. 8).

Figure 9:
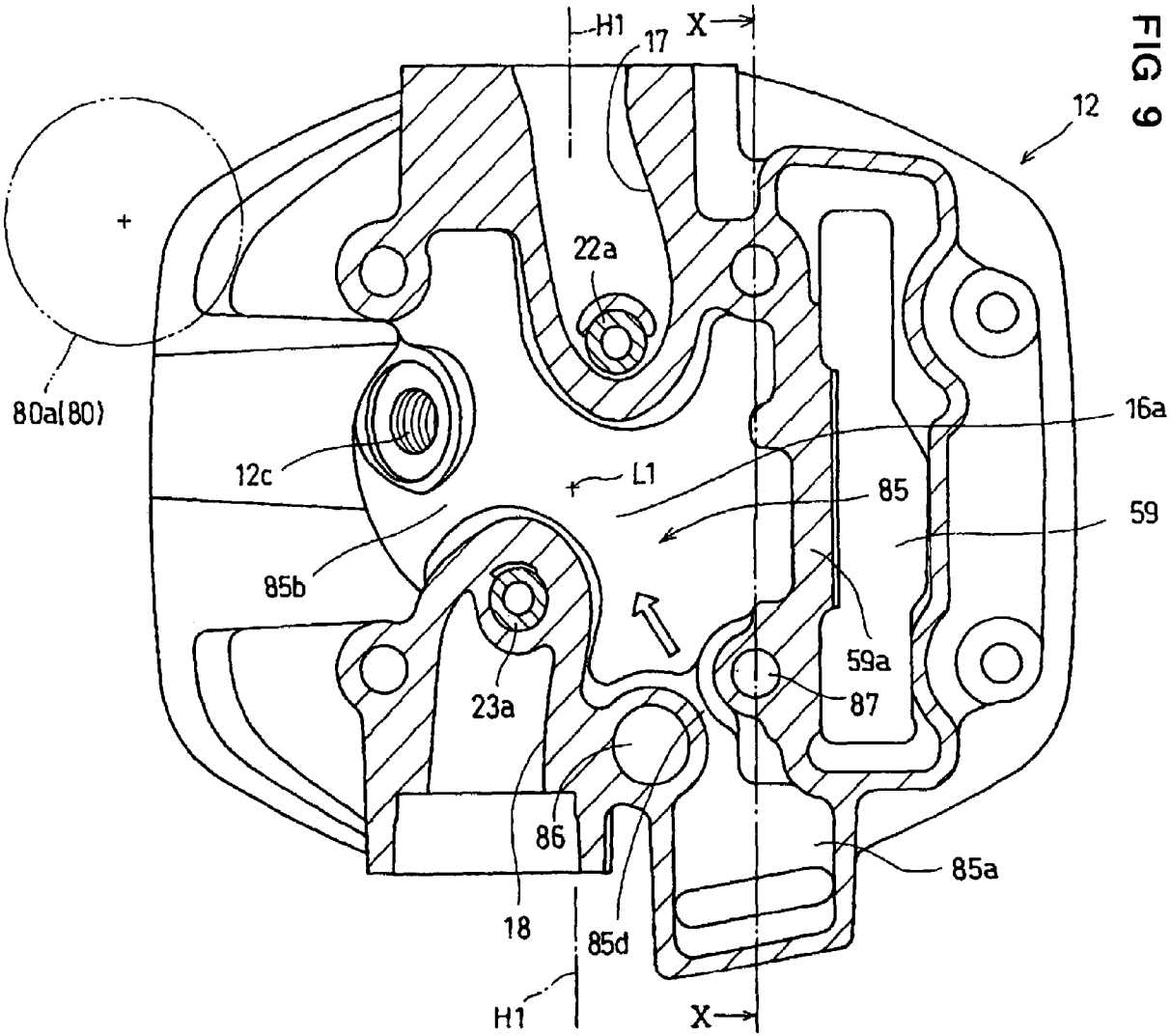
FIG. 9 is a sectional view along arrow IX—IX of FIG. 10.
Figure 10:
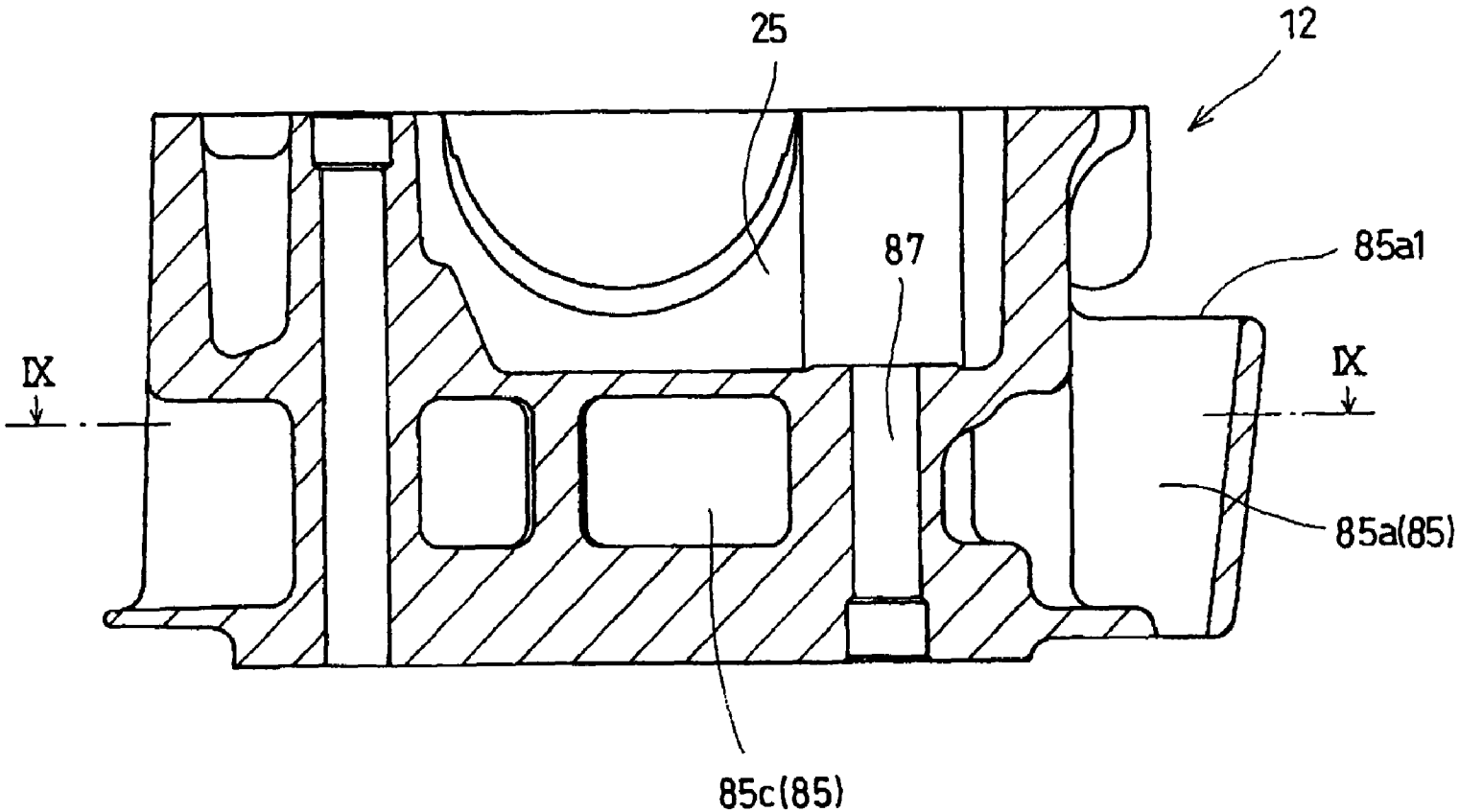
FIG. 10 is a sectional view along arrow X—X of FIGS. 4 and 9.

Referring to FIGS. 9 and 10 also, the main body 80*a* of the electric motor 80 overlapping with the cylinder head 12 and the head cover 13 in the cylinder axis direction A1 and disposed on the outer side relative to the cylinder head 12 and the head cover 13 in the radial direction and in the exterior of the valve chamber 25 is disposed at a position which is adjacent to a circumferential wall 13*b* of the head cover 13 in the radial direction and at which the running airflow having passed through a duct 85 formed between the valve chamber 25 and the combustion chamber 16 in the cylinder head 12 collides on the main body 80*a* as a cooling airflow. The duct 85 has the inlet portion 85*a* (see FIG. 4 also) having an inlet 85*a*1 opened toward the front side of the motorcycle V so as to take in the running airflow, the outlet portion 85*b* at which the spark plug 19 is disposed and which is opened at such a position that the running airflow (cooling airflow) coming from the inlet portion 85*a* collides on the main body 80*a*, and a central portion 85*c* formed by duct walls including a combustion chamber wall 16*a* for communication between the inlet portion 85*a* and the outlet portion 85*b* and a valve chamber wall 25*a* opposed to the combustion chamber wall 16*a* in the cylinder axis direction A1.

The inlet portion 85*a* projects toward the outer side in the radial direction and the lower side relative to the head cover 13, and the inlet 85*a*1 is opposed to the running airflow. Of the duct 85, the portion opposed to the outlet portion 85*b* with the first orthogonal plane H1 therebetween is closed by a chamber wall 59*a* of the power transmission chamber 59 which constitutes the duct wall of the central portion 85*c*. Between the inlet portion 85*a* and the central portion 85*c*, a restriction portion 85*d* smaller in passage area than those on the inlet portion 85*a* side and on the central portion 85*c* side is formed by a passage wall of a return oil passage 86 for a lubricating oil having lubricated the valve system 40 and by a boss provided with an insertion hole 87 for a head bolt. In addition, the restriction portion 85*d* is so shaped as to cause the running airflow coming from the inlet portion 85*a* to flow toward a portion, near the main body 80*a*, of the outlet portion 85*b*.

Therefore, the running airflow entering via the inlet 85*a*1 at the time of running flows through the inlet portion 85*a* into the central portion 85*c*, cools the combustion chamber wall 16*a* and the valve chamber wall 25*a*, then flows toward the outlet portion 85*b*, cools the spark plug 19 at the outlet portion 85*b*, and flows out via the outlet portion 85*b*. Apart of the running airflow having flowed out of the outlet portion 85*b* collides on the main body 80*a*, thereby cooling the main body 80*a*.

Referring to FIGS. 2, 3 and 8, in the valve chamber 25, the transmission mechanism M4 disposed between the camshaft holder 29 and the head cover 13 in the cylinder axis direction A1 is composed of a speed reduction gear 81 meshed with a drive gear 80*b*1 formed on the output shaft 80*b* penetrating through the head cover 13 and extending into the valve chamber 25, and an output gear 82 which is meshed with the speed reduction gear 81 and is rotatably supported on the cylinder head 12 through the camshaft holder 29. The speed reduction gear 81 is rotatably supported on a support shaft 84 supported by the head cover 13 and a cover 83 for covering an opening 13*c* formed in the head cover 13, and has a large gear 81*a* meshed with the drive gear 80*b*1, and a small gear 81*b* meshed with the output gear 82. The output gear 82 has a hollow cylindrical boss portion 82*a* which is rotatably supported, through a bearing 89, on a holding tube 88 connected to the camshaft holder 29 by bolts.

The output gear 82 and the control shaft 70 are drive connected to each other through a feed screw mechanism serving as a motion conversion mechanism by which the rotational motion of the output gear 82 is converted into a rectilinear reciprocating motion, parallel to the cylinder axis L1, of the control shaft 70. The feed screw mechanism comprises a female screw portion 82*b* composed of a trapezoidal screw formed in the inner circumferential surface of the boss portion 82*a*, and a male screw portion 70*b* composed of a trapezoidal screw formed in the outer circumferential surface of the control shaft 70 and meshed with the female screw portion 82*b*. The control shaft 70 is slidably fitted over the outer circumference of a guide shaft 90 fixed to the boss portion 82*a*, and can be advanced and retracted relative to the camshaft 50 in the cylinder axis direction A1 through a through-hole 91 (see FIG. 5 also) formed in the camshaft holder 29, while being guided in the moving direction by the guide shaft 90.

Referring to FIG. 3, the electric motor 80 is controlled by an electronic control unit (hereinafter referred to as ECU) 92. For this purpose, detection signals are inputted to the ECU 92 from operating condition detection means 93, which is composed of starting detection means for detecting the starting time of the internal combustion engine E, load detection means for detecting the engine load, engine speed detection means for detecting the engine speed, and the like and which detects the operating conditions of the internal combustion engine E, and from swing position detection means 94 (composed, for example, of a potentiometer) for detecting the swing position, or the swing angle relative to the camshaft 50, of the holder 60*e* of the exhaust link mechanism Mle swung by the electric motor 80, hence of the exhaust cam 54.

Therefore, when the position of the control shaft 70 driven by the electric motor 80 is changed, the swing position which is the rotation position of the exhaust link mechanism Mle (intake link mechanism Mli) and the exhaust cam 54 (intake cam 53) relative to the camshaft 50 is changed according to the operating conditions, so that the valve operation characteristics of the exhaust valve 23 (intake valve 22) are controlled according to the operating conditions of the internal combustion engine E by the valve characteristic varying mechanism M controlled by the ECU 92.

Details of the above will be described below.

Figure 11:
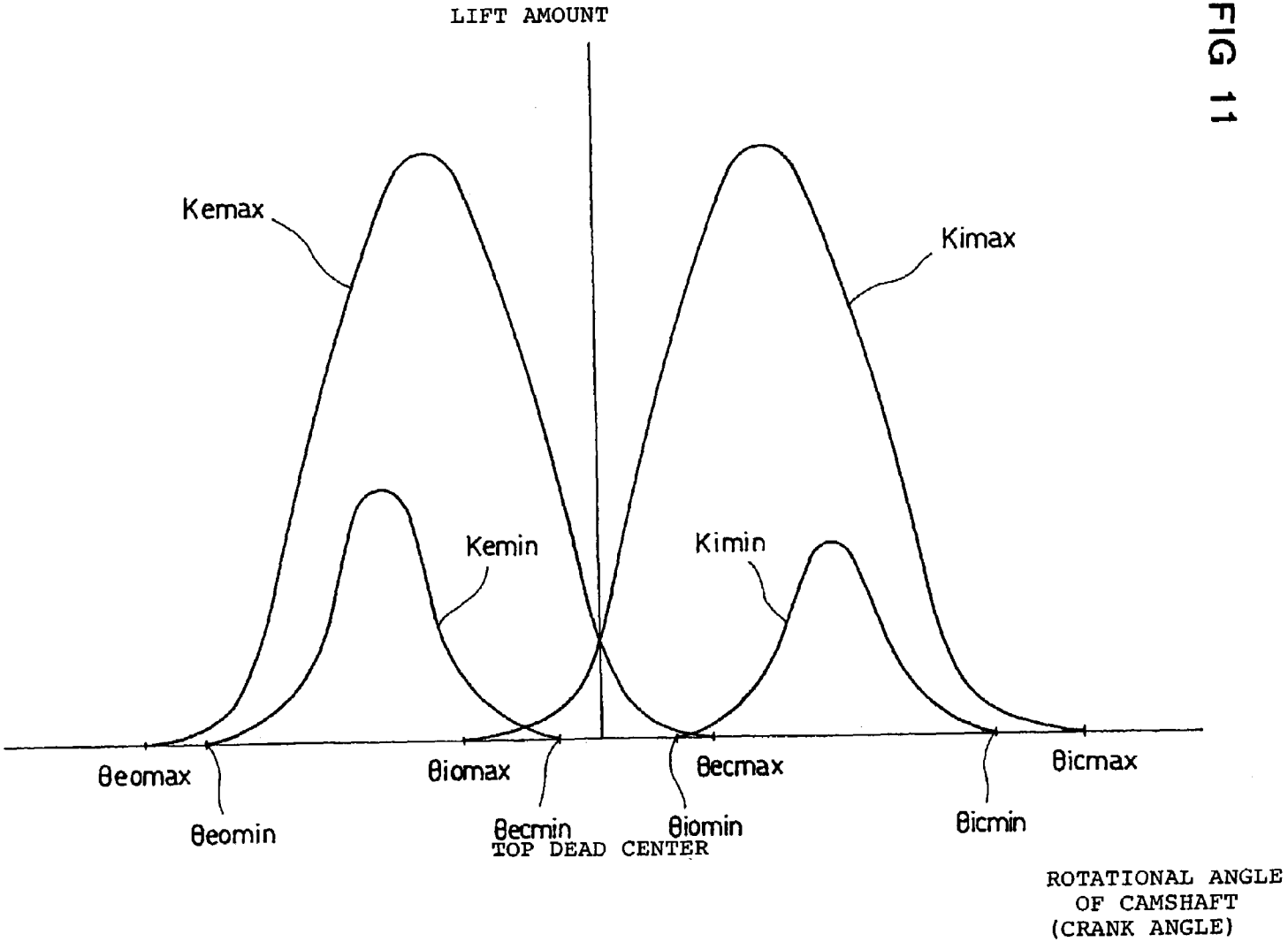
FIG. 11 is an illustration of the valve operation characteristics of the intake valve and the exhaust valve effected by the valve system for the internal combustion engine of FIG. 1.

As shown in FIG. 11, the intake valve and the exhaust valve are respectively put into opening and closing operations with arbitrary intermediate valve operation characteristics between maximum valve operation characteristics Kimax, Kemax and minimum valve operation characteristics Kimin, Kemin, with the maximum valve operation characteristics Kimax, Kemax and the minimum valve operation characteristics Kimin, Kemin as boundary values of basic operation characteristics of valve operation characteristics Ki, Ke controlled by the valve characteristic varying mechanism M for changing the opening and closing timings and the maximum lift amounts. Therefore, regarding the intake valve 22, as the opening timing is continuously retarded on an angle basis, the closing timing is continuously advanced on an angle basis to continuously shorten the valve opening period, further, the rotational angle of the camshaft 50 (or the crank angle as a rotational position of the crankshaft 15) for obtaining the maximum lift amount is continuously retarded on an angle basis, and the maximum lift amount is continuously reduced. Simultaneously with the changes in the valve operation characteristics of the intake valve 22, regarding the exhaust valve 23, as the opening timing is continuously retarded on an angle basis, the closing timing is continuously advanced to continuously shorten the valve opening period, further, the rotational angle of the camshaft 50 for obtaining the maximum lift amount is continuously advanced on an angle basis, and the maximum lift amount is continuously reduced.

Referring to FIG. 12 also, when the control shaft 70 driven by the drive mechanism M2 and the intake control link 71*i* occupy first positions shown in FIGS. 12(A), 12(B), the maximum valve operation characteristic Kimax is obtained such that the opening timing of the intake valve 22 is at a most advanced angle position θ iomax, the closing timing is at a most retarded angle position θ icmax, and the valve opening period and the maximum lift amount are both maximized; simultaneously, the maximum valve operation characteristic Kemax is obtained such that the opening timing of the exhaust valve 23 is at a most advanced angle position θ eomax, the closing timing is at a most retarded angle position θ ecmax, and the valve opening period and the maximum lift amount are both maximized.

Incidentally, in FIGS. 12 and 13, the conditions of the exhaust link mechanism Mle (intake link mechanism Mli) and the exhaust main rocker arm 42 (intake main rocker arm 41) at the time when the exhaust valve 23 (intake valve 22) is closed are indicated by solid lines and broken lines, whereas the general conditions of the exhaust link mechanism Mle (intake link mechanism Mli) and the exhaust main rocker arm 42 (intake main rocker arm 41) at the time when the exhaust valve 23 (intake valve 22) is opened at the maximum lift amount are indicated by two-dotted chain lines.

During transition from the condition where the maximum valve operation characteristics Kimax, Kemax are obtained by the valve characteristic varying mechanism M to the condition where the minimum valve operation characteristics Kimin, Kemin are obtained, according to the operating conditions of the internal combustion engine E, the electric motor 80 drives the output gear 72 to rotate, and the control shaft 70 is advanced toward the camshaft 50 by the feed screw mechanism. In this instance, based on the drive amount of the electric motor 80, the control shaft 70 swings the intake link mechanism Mli and the intake cam 53 in the rotational direction R1 about the camshaft 50 through the intake control link 71*i*, and, simultaneously, swings the exhaust link mechanism Mle and the exhaust cam 54 in the counter-rotational direction R2 about the camshaft 50 through the exhaust control link 71*e*.

When the control shaft 70 and the exhaust control link 71*e* occupy second positions shown in FIGS. 13(A), 13(B), the minimum valve operation characteristic Kimax is obtained such that the opening timing of the intake valve 22 is at a most retarded angle position θ iomin, the closing timing is at a most advanced angle position θ icmin, and both the valve opening period and the maximum lift amount are minimized; simultaneously, the minimum valve operation characteristic Kemin is obtained such that the opening timing of the exhaust valve 23 is at a most retarded angle position θ eomin, the closing timing is at a most advanced angle position θ ecmin, and both the valve opening period and the maximum lift amount are minimized.

During transition of the control shaft 70 from the second position to the first position, the electric motor 80 drives the output gear 82 to rotate in the reverse direction, and the control shaft 70 is retracted away from the camshaft 50 by the feed screw mechanism. In this instance, the control shaft 70 swing the intake link mechanism Mli and the intake cam 53 in the counter-rotational direction R2 about the camshaft 50 through the intake control link 71*i*, and, simultaneously, swing the exhaust link mechanism Mle and the exhaust cam 54 in the rotational direction R1 about the camshaft 50 through the exhaust control link 71*e*.

In addition, when the control shaft 70 occupies a position between the first position and the second position, regarding the exhaust valve 23 (intake valve 22), innumerable intermediate valve characteristics are obtained such that the opening timing, the closing timing, the valve opening period and the maximum lift amount are set at values respectively between the opening timing, the closing timing, the valve opening period and the maximum lift amount at the maximum valve operation characteristic Kemax (Kimaxa) and those at the minimum valve operation characteristic Kemin (Kimin).

The intake valve and the exhaust valve are put into opening and closing operations with auxiliary operation characteristics, in addition to the above-mentioned basic operation characteristics, by the valve characteristic varying mechanism M. Specifically, the fact that decompression operation characteristics as the auxiliary operation characteristics can be obtained will be described referring to FIGS. 14(A), 14(B). During the compression stroke upon the starting of the internal combustion engine E, the electric motor 80 drives the output gear 82 to rotate in the reverse direction, and the control shaft 70 occupies a decompression position where it is retracted beyond the first position so as to be located away from the camshaft 50. In this case, the exhaust link mechanism Mle (intake link mechanism Mli) and the exhaust cam 54 (intake cam 53) are swung in the rotational direction R1 (counter-rotational direction R2), the decompression cam 62*e*1 (62*i*1) of the second plate 62*e* (62*i*) makes contact with a decompression portion 42*d* (41*d*) provided in the vicinity of the roller 42*c* (41*c*) of the exhaust main rocker arm 42 (intake main rocker arm 41), the roller 42*c* (41*c*) parts from the exhaust cam 54 (intake cam 53), and the exhaust valve 23 (intake valve 22) is opened at a small decompression opening.

Now, the functions and effects of the embodiment configured as above will be described below.

The cylinder head 12 for forming the combustion chamber 16 and the valve chamber 25 is provided with the duct 85, for guiding the running airflow, between the valve chamber 25 and the combustion chamber 16, and the electric motor 80 is disposed at a position which is outside the valve chamber 25 and at which the running airflow having flowed through the duct 85 collides on the electric motor 80. This configuration ensures that the running airflow is guided by the duct 85 to collide on the electric motor 80 as a cooling airflow, thereby cooling the electric actuator, so that good performance of cooling the electric motor 80 is secured. In addition, it is unnecessary to lay out the electric motor 80 at such a position that the running airflow collides directly on the electric motor 80, while avoiding the cylinder head 12 and members disposed in the vicinity of the cylinder head 12. The duct 85 can be formed to match the position of the electric motor 80, so that the degree of freedom in laying out the electric motor 80 is enhanced. In addition, since the electric motor 80 disposed adjacent to the valve chamber 25 in the radial direction with respect to the cylinder axis L1 can be laid out close to the cylinder head 12 and the head cover 13 in the radial direction, the electric motor 80 can be laid out at the cylinder head 12 and the head cover 13 in a compact form in the radial direction. Besides, it is possible to prevent the valve system 40 comprising the valve characteristic varying mechanism M having the electric motor 80 from being enlarged in size in the cylinder axis direction A1 and, hence, to prevent the internal combustion engine E from being enlarged in size. Further, since the duct is formed between the combustion chamber 16 and the valve chamber 25, the combustion chamber wall 16*a* is cooled by the running airflow passing through the duct 85, and the heating of the valve chamber 25 by the heat transferred from the combustion chamber 16 is restrained, so that the performance of cooling the combustion chamber wall 16*a* is enhanced, and the valve chamber 25 is prevented from being heated to a high temperature.

Since the electric motor 80 comprises the output shaft 80*b* extending in parallel to the cylinder axis L1, the electric motor 80 can be laid out along the cylinder axis L1. Further, the electric motor 80 as a whole can be disposed closer to the cylinder axis L1, as compared with the case where the output shaft 80*b* extends in parallel to an orthogonal plane which is orthogonal to the cylinder axis L1. As a result, the electric motor 80 can be laid out at the cylinder head 12 in a compacter form in the radial direction.

In the cylinder head 12, the power transmission chamber 59 and the inlet portion 85*a* are disposed on the left side of the first orthogonal plane H1, and the main body 80*a* of the electric motor 80, the spark plug 19 and the outlet portion 85*b* are disposed on the right side of the first orthogonal plane H1, whereby the main body 80*a* and the power transmission chamber 59 occupying a comparatively large volume are disposed distributedly on both sides of the first orthogonal plane H1. In this point, also, the electric motor 80 is disposed at the cylinder head 12 and the head cover 13 in a compact form in the radial direction.

The electric motor 80 is mounted to the mount portion 13*a* formed on the head cover 13, and the main body 80*a* of the electric motor 80 is disposed at such a position that the whole part thereof is covered by the mount portion 13*a*, as viewed from the front side of the head cover 13, whereby the electric motor 80 is shielded by the mount portion 13*a*. Therefore, foreign matter such as a small stone kicked up by the front wheel 7 or the like during the running of the motorcycle V is prevented from colliding against the main body 80*a*.

Of the duct 85, the portion opposed to the outlet portion 85*b* with the first orthogonal plane H1 therebetween is closed by the chamber wall 59*a* of the power transmission chamber 59 constituting the duct wall of the central portion 85*c*, whereby it is ensured that the running airflow entering into the central portion 85*c* mostly flows toward the outlet portion 85*b*, so that the spark plug 19 and the main body 80*a* are efficiently cooled by a large quantity of the running airflow. Between the inlet portion 85*a* and the central portion 85*c*, the restriction portion 85*d* is formed in such a shape as to cause the running airflow coming from the inlet portion 85*a* to flow toward the portion, near the main body 80*a*, of the outlet portion 85*b*, whereby it is made easier for the running airflow to collide on the main body 80*a*. In this point, also, the performance of cooling the main body 80*a* is enhanced.

Now, an embodiment obtained by partly changing the constitution of the above-described embodiment will be described below, in special regard of the modifications.

The internal combustion engine E may be a multi-cylinder internal combustion engine. Further, the internal combustion engine E may be an internal combustion engine in which one cylinder is provided with a plurality of intake valves and one or a plurality of exhaust valves, or may be an internal combustion engine in which one cylinder is provided with a plurality of exhaust valves and one or a plurality of intake valves.

The electric motor 80 may be mounted to the cylinder head 12. The swing position detection means 94 may detect the swing position of the holder 60*i* of the intake link mechanism Mli.

We claim:

1. An internal combustion engine for a motor vehicle comprising:

a cylinder head and head cover, said cylinder head connected to at least one cylinder, the cylinder head at least partially defining a combustion chamber with said cylinder and partially defining a valve chamber;

an air duct directing air for cooling and not for combustion, said air duct at least partially disposed between the combustion chamber and the valve chamber, said air duct formed by duct walls in said cylinder head including a combustion chamber wall and a valve chamber wall, wherein the air in the air duct cools the combustion chamber wall and the valve chamber wall; and a valve characteristic varying mechanism for controlling a valve operation characteristic of an intake valve and an exhaust valve, the valve characteristic varying mechanism including an electric actuator disposed outside of the cylinder head and the head cover in an air flow path of the air duct so that said electric actuator is also cooled by the air which flows in the air duct.

2. The internal combustion engine according to claim 1, wherein the electric actuator is positioned adjacent to the valve chamber in a radial direction from the valve chamber, wherein the radial direction is defined with respect to a longitudinal axis of the cylinder.

3. The internal combustion engine according to claim 2, wherein the electric actuator comprises an output shaft extending in parallel to the longitudinal axis of the cylinder.

4. The internal combustion engine according to claim 2, wherein the valve characteristic varying mechanism is positioned on the valve chamber such that the length of the internal combustion engine measured along a longitudinal axis of the combustion chamber is not substantially increased.

5. An internal combustion engine for a motor vehicle comprising:

a combustion chamber;

a valve chamber connected to the combustion chamber;

a duct for directing airflow between the valve chamber and the combustion chamber;

an electric motor connected to the outside of the valve chamber positioned such that the directed airflow cools the electric motor;

said internal combustion engine further comprising a first side and a second side, the first side comprising:

a power transmission chamber;

an inlet portion of the duct; and the second side comprising:

a spark plug;

an outlet portion of the duct; and the electric motor.

6. The internal combustion engine according to claim 5, wherein the electric motor is positioned on the valve chamber such that the length of the internal combustion engine measured along a longitudinal axis of the combustion chamber is not substantially increased.

7. The internal combustion engine according to claim 5, wherein the duct also directs air towards the spark plug for cooling.

8. The internal combustion engine according to claim 5, wherein the engine comprises multiple cylinders, each cylinder having a plurality of valves.

9. A motorcycle having an internal combustion engine comprising:

a cylinder head and a head cover attached to said cylinder head;

a combustion chamber formed at least partially by said cylinder head;

a valve chamber formed at least partially by said cylinder head and connected to the combustion chamber;

a duct formed in said cylinder head for directing airflow between the valve chamber and the combustion chamber;

an electric motor disposed to the outside of the valve chamber positioned such that the airflow directed from the duct cools the electric motor; and a protective mount extending from said head cover, said electric motor being mounted to the mount with the mount being positioned over the electric motor to protect it from road debris.

* * * * *